US012416147B2

(12) United States Patent
Cadeau et al.

(10) Patent No.: US 12,416,147 B2
(45) Date of Patent: Sep. 16, 2025

(54) UNIVERSAL BASE PLATE WITH TABS

(71) Applicant: Advanced Drainage Systems, Inc., Hilliard, OH (US)

(72) Inventors: Jeremy Cadeau, Cumming, GA (US); Courtney Ashliman, Gainesville, GA (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 136 days.

(21) Appl. No.: 17/963,477

(22) Filed: Oct. 11, 2022

(65) Prior Publication Data

US 2024/0117621 A1 Apr. 11, 2024

(51) Int. Cl.
*E03F 1/00* (2006.01)
*E03F 5/04* (2006.01)
*E03F 5/10* (2006.01)

(52) U.S. Cl.
CPC ..... *E03F 5/04* (2013.01); *E03F 1/002* (2013.01); *E03F 5/10* (2013.01)

(58) Field of Classification Search
CPC ..... E03F 5/04; E03F 1/002; E03F 5/10; E03F 5/046
See application file for complete search history.

(56) References Cited

U.S. PATENT DOCUMENTS 4,207,632 A * 6/1980 Savell, Jr. ..... E03C 1/20 285/58
4,261,824 A * 4/1981 Cuschera ..... E03F 5/06 210/164
4,419,232 A * 12/1983 Arntyr ..... E03F 5/0404 210/170.03
6,086,758 A * 7/2000 Schilling ..... B01D 39/1623 210/485
6,270,663 B1 * 8/2001 Happel ..... B01D 35/22 210/170.03
6,595,721 B2 * 7/2003 Kincheloe ..... E03F 5/06 405/125

(Continued)

FOREIGN PATENT DOCUMENTS

EP 3339522 A1 6/2018
KR 20070052722 A 5/2007

OTHER PUBLICATIONS

International Search Report dated Jan. 30, 2024, PCT/US2023/034960.

*Primary Examiner* — Edwin J Toledo-Duran
(74) *Attorney, Agent, or Firm* — FINNEGAN, HENDERSON, FARABOW, GARRETT & DUNNER L.L.P.

(57) ABSTRACT

Fluid runoff systems, methods, and apparatus for processing fluid runoff are provided. In one implementation, a base plate for receiving an inlet casting at a drain basin may be provided. The base plate may include a flat surface with an aperture and an outside edge surrounding the flat surface; a raised lip may surround the outside edge and a flange may extend in a horizontal direction away from the raised lip. The flange may define a flat surface for an inlet casting. The base plate may further include one or more sets of tabs located on the underside of the plate. In another implementation, a fluid runoff system may comprise an inlet casting, a base plate, a drain basin, and a pipe. The base plate may include one or more sets of tabs for connecting with the drain basin.

20 Claims, 19 Drawing Sheets

(56) References Cited

U.S. PATENT DOCUMENTS

| | | | | |
|---|---|---|---|---|
| 6,942,425 | B2 * | 9/2005 | Kincheloe | E03F 5/04 405/125 |
| 7,112,274 | B1 * | 9/2006 | Sanguinetti | B01D 29/01 210/474 |
| 7,201,843 | B2 * | 4/2007 | Sasaki | B01D 29/27 210/478 |
| 7,297,265 | B1 * | 11/2007 | Booth | B01D 29/688 210/411 |
| 7,771,591 | B2 * | 8/2010 | Lucas | E03F 5/0404 210/489 |
| 9,157,213 | B2 * | 10/2015 | Beaudoin | E03F 5/06 |
| 9,752,314 | B2 * | 9/2017 | Wiebke | E03C 1/22 |
| 9,963,866 | B2 | 5/2018 | Nemec | |
| 10,724,224 | B2 | 7/2020 | Deurloo et al. | |
| 11,072,916 | B2 * | 7/2021 | Coy | E03F 5/0408 |
| 11,319,698 | B2 * | 5/2022 | Coy | E03F 5/0409 |
| 11,332,918 | B2 * | 5/2022 | Deurloo | E03F 5/0404 |
| 11,976,456 | B2 * | 5/2024 | Cislo | E03F 1/00 |
| 2005/0103694 | A1 * | 5/2005 | Rost | E03F 5/0404 210/164 |
| 2010/0000933 | A1 * | 1/2010 | Zuk, Jr. | B01D 63/087 210/406 |
| 2012/0047643 | A1 * | 3/2012 | Meyers | E03F 5/041 4/292 |
| 2016/0090727 | A1 * | 3/2016 | Elliott | E03F 7/00 285/42 |
| 2016/0333565 | A1 * | 11/2016 | Clinton | E03F 5/041 |
| 2021/0095459 | A1 * | 4/2021 | Deurloo | E03F 5/042 |
| 2021/0372113 | A1 * | 12/2021 | Cislo | F16L 21/002 |

* cited by examiner

UNIVERSAL BASE PLATE WITH TABS

TECHNICAL FIELD

This disclosure relates generally to systems, apparatus, and methods for fluid runoff management. In particular, this disclosure relates to an underground draining system that includes a base plate, drain basin, and pipe that directs fluid runoff through the system to a downspout drain or storm sewer.

BACKGROUND

Fluid runoff management systems include systems designed to process rainwater or other fluid runoff, particularly stormwater. Fluid runoff can occur when excess stormwater is no longer able to be absorbed into surrounding soil. Additionally, in more urban areas with less natural landscapes, nonporous surfaces, such as roads and parking lots, prevent the absorption of stormwater. Excess stormwater then floods the surrounding land or flows into surrounding bodies of water, such as creeks, streams, or ponds. Fluid runoff management systems can be used to prevent the buildup of stormwater and to direct stormwater to certain areas. Fluid runoff management systems may include landscaping and site management control, such as eliminating paved surfaces, adding porous pavement, or adding plants to promote absorption of stormwater. Fluid runoff management systems may also include structural elements to direct stormwater away from an area. These structural elements may include a drain basin, catch basin, or sewer.

A fluid runoff management system may include a drain basin for use with an inlet casting. For example, an inlet casting may allow excess stormwater to drain into a drain basin. The drain basin may then be attached to a pipe that delivers the stormwater to a different location. The pipe may deliver the stormwater to a nearby water source or to a water treatment facility. This type of management system may prevent flooding of surrounding areas by removing excess stormwater. Additionally, this type of system may prevent the buildup of pollutants in water because the stormwater will flow into the drain basin instead of yards or roads, where the stormwater could collect contaminants. A fluid runoff system may also include a square or rectangular inlet grate, a base transition plate, a round drain basin, or other types of inlets.

Fluid runoff management systems may be designed to be installed in a variety of applications. Fluid runoff systems may be installed in a structural setting, such as a high-traffic area, around buildings, sidewalks, or other man-made areas. In those situations, an inlet may include a curb inlet, or an inlet placed in a road or sidewalk to collect stormwater. Fluid runoff systems may also be installed in a natural setting. For example, a system may be installed in the ground. In this situation, an inlet may receive runoff from the surrounding land.

Existing fluid runoff management systems may include a curb inlet with a curb opening for accepting stormwater, a drain basin attached to the curb inlet, and a pipe for removing the stormwater from the drain basin. Drain basins may be manufactured in different shapes and sizes and may have different diameters. Additionally, not all drain basins may be manufactured to fit within a curb inlet, which can lead to an increased number of parts being needed to construct a fluid runoff system. Further, there is a risk that a part, specifically a drain basin, may not fit within the fluid runoff system.

Curb inlets may also be manufactured in different shapes, sizes, and materials. A broad range of casting designs may be used to create a curb inlet. Therefore, not all inlets may be designed to fit with a base plate.

Thus, solutions are needed to improve these and other deficiencies in fluid runoff systems. Such solutions should reduce labor and costs by reducing the number of parts needed for a fluid runoff system. Solutions should also include a simplified system that can accommodate multiple different types and sizes of drain basins, including drain basins with varying diameters. Solutions should also include a system that can accommodate a broad range of domestic foundry casting designs for curb inlets. An improved system includes a system that can take domestically produced square and rectangular castings and adapt the castings to round drain basins. Further solutions should allow for ease of assembly and improve of the construction process. Solutions should also be durable and able to withstand different loads and stresses, including loads and stresses that may be encountered in a traffic application. Solutions should also provide more exact connections between the drain basin and curb inlet to prevent fluid from escaping back into the environment once it is captured at the inlet.

SUMMARY

The disclosed embodiments describe systems, methods, and devices for managing fluid runoff. These systems, methods, and devices may include the use of a base plate, or the use of a fluid runoff system that includes a base plate. For example, in an embodiment, a base plate may include a plate having a flat surface with an aperture and an outside edge surrounding the flat surface. The flat surface may include an underside and a topside. One or more sets of tabs may be located on the underside of the plate. The base plate may further include a raised lip surrounding the outside edge, wherein the raised lip extends upward from the outside edge. The base plate may further include a flange extending in a horizontal direction away from the raised lip and the flange may define a relatively flat surface to receive an inlet casting.

In an embodiment, one or more sets of tabs may comprise a set of inside tabs and a set of outside tabs.

In an embodiment, the set of inside tabs and the set of outside tabs may project downward relative to the underside of the baseplate.

In an embodiment, the set of inside tabs may comprise four tabs and the set of outside tabs may comprise four tabs.

In an embodiment, the inside tabs may be arranged in a first circular pattern around the aperture. Each tab in the set of inside tabs may be located a first distance equidistant from a center of the aperture. The outside tabs may also be arranged in a second circular pattern around the aperture. The second circular pattern may be located farther away from the aperture than the first circular pattern. Each tab in the set of outside tabs may be located a second distance equidistant from the center of the aperture. The second distance may be greater than the first distance.

In an embodiment, each tab in the set of outside tabs may be located a fixed radial distance from the set of inside tabs.

In an embodiment, each tab in the set of inside tabs may be aligned with each tab in the set of outside tabs.

In an embodiment, each tab in the set of inside tabs may not be aligned with each tab in the set of outside tabs.

In an embodiment, the inner diameter of the first circular pattern may fit an outside diameter of a 24-inch basin.

In an embodiment, the inner diameter of the second circular pattern may fit an outside diameter of a 30-inch basin.

In an embodiment, the flange may include a chamfered edge.

In an embodiment, the flat surface may include four sides. A length of the flange on one side may be longer than a length of the flange on the other sides.

In an embodiment, the base plate may be comprised of ductile iron.

In an embodiment, a fluid runoff system may include an inlet casting. The fluid runoff system may also include a base plate for receiving the inlet casting. The base plate may include a plate having a flat surface with an aperture and an outside edge surrounding the flat surface. The flat surface may include an underside and a topside. One or more sets of tabs may be located on the underside of the plate. The one or more sets of tabs may include a set of inside tabs and a set of outside tabs that project downward relative to the underside of the plate. The one ore most sets of tabs may be comprised of four tabs each. The plate may include a raised lip surrounding the outside edge. The raised lip may extend upward from the outside edge. The plate may include a flange with a chamfered edge extending in a horizontal direction away from the raised lip. The flange may define a relatively flat surface to receive the inlet casting. The fluid runoff system may include a drain basin below the baseplate. The drain basin may have a tubular body. The tubular body may include an inner cavity, an outer surface, and a top end. The plate may include a pipe connected to the tubular body.

In an embodiment, the inside tabs may be arranged in a first circular pattern around the aperture. Each tab in the set of inside tabs may be located a first distance equidistant from a center of the aperture. The outside tabs may also be arranged in a second circular pattern around the aperture. The second circular pattern may be located farther away from the aperture than the first circular pattern. Each tab in the set of outside tabs may be located a second distance equidistant from the center of the aperture. The second distance may be greater than the first distance. Each tab in the set of outside tabs may be located a fixed radial distance from the set of inside tabs. In one embodiment, each tab in the set of inside tabs may be aligned with each tab in the set of outside tabs. In another embodiment, each tab in the set of inside tabs may not be aligned with each tab in the set of outside tabs. In one embodiment, the inner diameter of the first circular pattern may fit an outside diameter of a 24-inch basin. In another embodiment, the inner diameter of the second circular pattern may fit an outside diameter of a 30-inch basin. Other diameters may also be used, as is apparent to one skilled in the art.

In an embodiment, the flat surface may include four sides. A length of the flange on one side may be longer than a length of the flange on the other sides.

In an embodiment, the fluid runoff system may include a reducing plate. The reducing plate may have a bottom surface and a top surface. The reducing plate may be located above the drain base and below the base plate.

In an embodiment, the top surface of the reducing plate may connect with a set of outside tabs.

In an embodiment, the bottom surface of the reducing plate may connect with the top end of the drain basin.

Additional features and advantages of the disclosed embodiments will be set forth in part in the description that follows, and in part will be obvious from the description, or may be learned by practice of the disclosed embodiments. The features and advantages of the disclosed embodiments will be realized and attained by the elements and combinations particularly pointed out in the appended claims.

It is to be understood that both the foregoing general description and the following detailed description are examples and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

DETAILED DESCRIPTION

Exemplary embodiments are described with reference to the accompanying drawings. In the FIG.s, which are not necessarily drawn to scale, the left-most digit(s) of a reference number identifies the FIG. in which the reference number first appears. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open ended in that an item or items following any one of these words is not meant to be an exhaustive listing of such item or items or meant to be limited to only the listed item or items. It should also be noted that as used in the present disclosure and in the appended claims, the singular forms "a," "an," and "the" include plural references unless the context clearly dictates otherwise.

A need has been recognized to standardize fluid runoff management systems. Existing fluid runoff management systems are comprised of different parts that may be manufactured by different sources. The separate parts of a fluid runoff system may not be sized to fit together. This creates a problem when trying to assemble the system since the parts may be created using different casting designs. Construction and assembly of the fluid runoff system may also be costly and inefficient. A single base plate may be required for each different size of a drain basin, leading to more parts, more labor, and higher costs when assembling a fluid runoff system.

The disclosed embodiments improve these and other deficiencies in fluid runoff management systems, specifically in base plates. For example, solutions are provided to reduce costs and labor by reducing the number of parts needed in a fluid runoff management system. Other improvements may include ensuring that different types and sizes of drain basis will fit within a base plate in a fluid runoff system. Some disclosed embodiments may include a base plate with one or more sets of tabs for connecting with different sized drain basins, allowing a single base plate to be used for a wide range of drain basins. In addition, some disclosed embodiments may include a reducing plate to further accommodate different sized drain basins. Additional improvements may include a base plate that may accept a number of different inlet casting designs. This also allows for a single base plate to accommodate different inlet casting designs.

Reference will now be made in detail to the disclosed embodiments, examples of which are illustrated in the accompanying drawings.

Figure 1A:
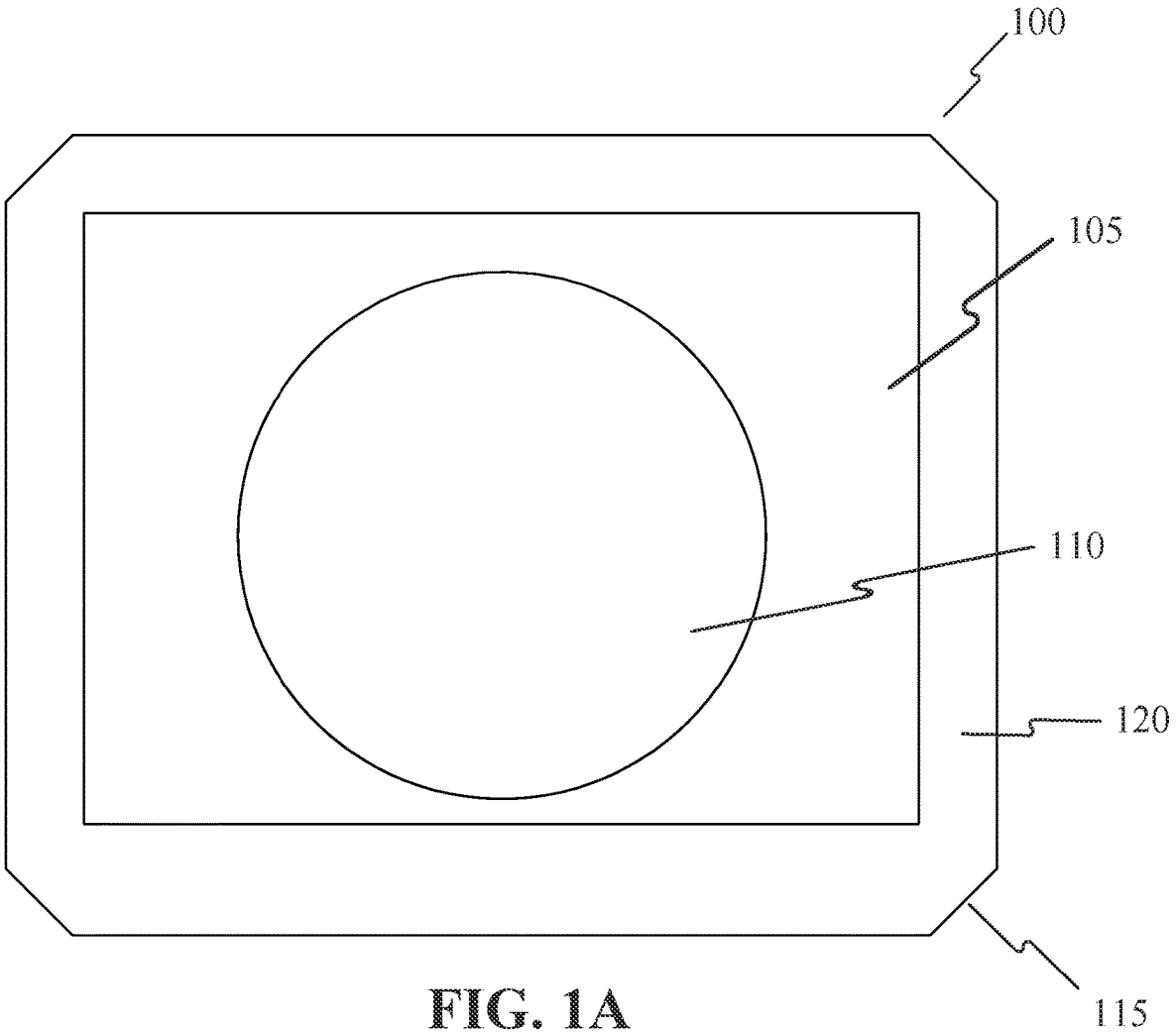
FIG. 1A depicts a top view of a base plate with two sets of tabs, consistent with various embodiments of the present disclosure.

FIG. 1A depicts a top view of a base plate with two sets of tabs, consistent with various embodiments of the present disclosure. Base plate 100 may include a flat surface 105 and aperture 110. Aperture 110 may be a circular shape or any other shaped opening. Aperture 110 may be located in the center, left, or right side of flat surface 105. In some embodiments, base plate 100 may be constructed of ductile iron, plastic and/or any other suitable material. Metal embodiments of base plate 100 may be formed, for example, through casting, molding, sheet metal forming, or any other suitable means. In some embodiments, plate 100 is configured to support structural loads, such as dead and live loads resulting from earthen embankments, surface loads, parking lots, structures, vehicular loads, for example the American Association of State Highway and Transportation Officials (AASHTO) H-20 loading criteria, and/or walking loads. The thickness or gauge of plate 100 may be determined by the structural load bearing requirements needed for the particular plate. Base plate 100 may be painted black and/or any other color.

In some embodiments, base plate 100 may include a flange 120. Flange 120 may include a chamfered edge 115.

Figure 1B:
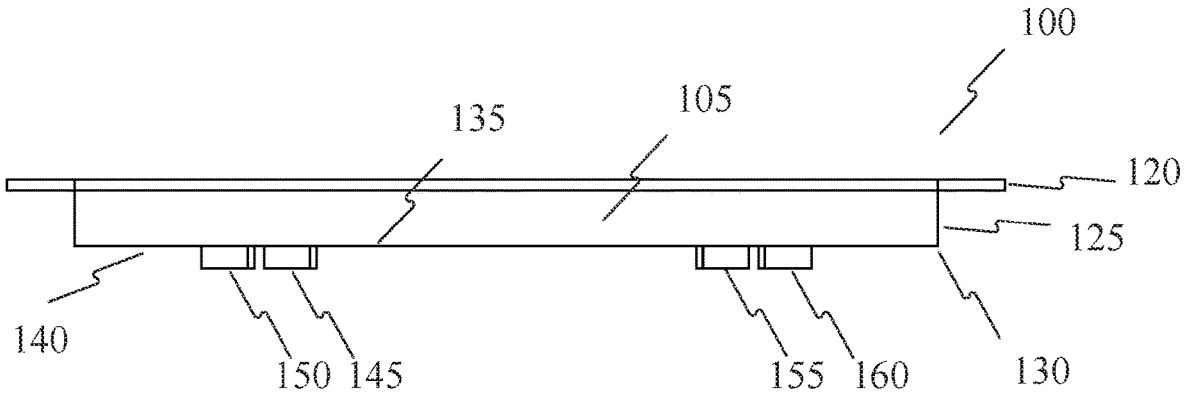
FIG. 1B depicts a side view of a base plate with two sets of tabs, consistent with various embodiments of the present disclosure.

FIG. 1B depicts a base plate 100 viewed from the side. Base plate 100 may include an outside edge 130 and a raised lip 125 may surround the outside edge 130. Raised lip 125 may extend upward from the outside edge 130. Raised lip 125 may connect with a flange 120. Flange 120 may extend in a horizontal direction away from raised lip 125. Flange 120 may be configured to define a relatively flat surface for receiving an inlet casting. Flange 120 may include chamfered edge 115, shown in FIG. 1A. Chamfered edge 115 may help further define flange 120 for receiving an inlet casting.

Flat surface 105 may include a topside 135 and an underside 140. Plate 100 may include tabs, 145, 150, 155, and 160, that may be located on the underside 140 of plate 100. Additionally, plate 100 may include tabs 165, 170, 175, and 180, shown in FIG. 1C. Tabs 145, 150, 155, and 160 may project downward relative to the underside 140 of plate 100. Tabs 145, 150, 155, and 160 may all have the same width and length or may have different lengths and widths.

Figure 1C:
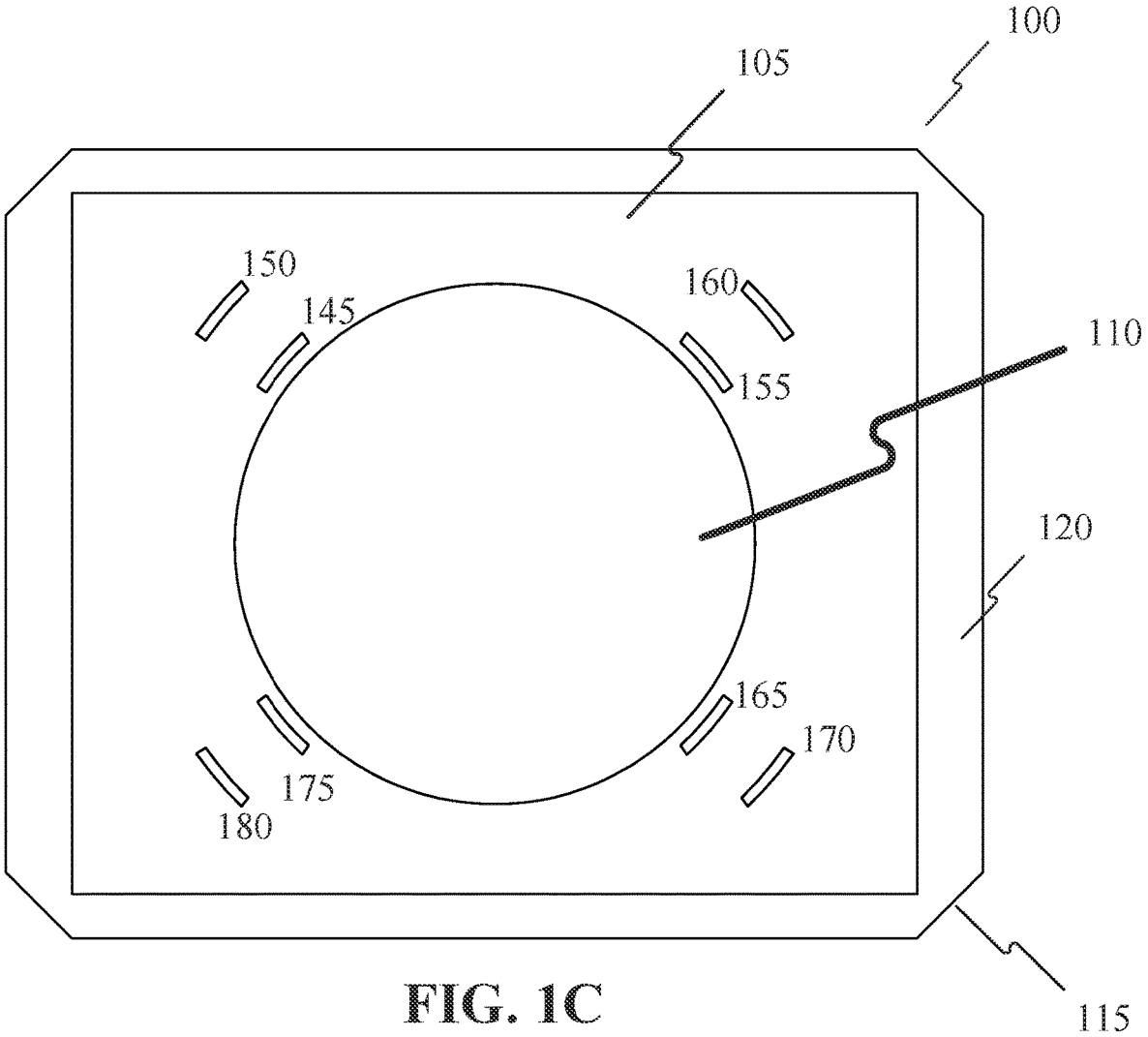
FIG. 1C depicts a bottom view of a base plate with two sets of tabs, consistent with various embodiments of the present disclosure.

FIG. 1C depicts a base plate 100 flipped upside down and viewed from the bottom. As shown in FIG. 1C, one embodiment of base plate 100 includes two sets of tabs. In another embodiment, base plate 100 may include 3, 4, 5, or any number of sets of tabs. A set of inside tabs may be comprised of four individual tabs 145, 155, 165, and 175. Inside tabs 145, 155, 165, and 175 may be arranged in a first circular pattern around aperture 110 on underside 140 of flat surface 105. A set of outside tabs may be comprised of four individual tabs 150, 160, 170, and 180. Outside tabs 150, 160, 170, and 180 may be arranged in a second circular pattern around aperture 110 on underside 140 of flat surface 105.

Inside tabs 145, 155, 165, and 175 may each be located at a first distance measured from the center of aperture 110. For example, each inside tab 145, 155, 165, and 175 may be located 12 inches from center of aperture 110. The distance of the first circular pattern created by inside tabs 145, 155, 165, and 175 may be determined by the first distance measured from the center of the aperture 110. For example, inside tab 145, 155, 165, and 175 may be located 12 inches from center of aperture 110, creating a first circular pattern with a diameter of 24 inches.

Within the first circular pattern, each inside tab 145, 155, 165, and 175 may be symmetrically spaced. The radial distance between each individual tab 145, 155, 165, and 175 may depend on the distance the tabs are located from the center of aperture 110. For example, a first circular pattern with a larger diameter may mean that the tabs are further apart from each other and a first circular pattern with a smaller diameter may mean that the tabs are closer together. For example, in a preferred embodiment, a first circular pattern may have a diameter of 24 inches, and each inside tab 145, 155, 165, and 175 may be located 12 inches from the center of aperture 110. Inside tab 145 may be located a radial distance of 6 inches from inside tab 155, which may be located a radial distance of 6 inches from inside tab 165, which may be located a radial distance of 6 inches from inside tab 175, which may be located a radial distance of 6 inches from inside tab 145. As another example, a first circular pattern may have a diameter of 20 inches, and each inside tab 145, 155, 165, and 175 may be located 10 inches from the center of aperture 110. Inside tab 145 may be located a radial distance of 5 inches from inside tab 155, which may be located a radial distance of 5 inches from inside tab 165, which may be located a radial distance of 5 inches from inside tab 175, which may be located a radial distance of 5 inches from inside tab 145.

Outside tabs 150, 160, 170, and 180 may each be located at a second distance measured from the center of aperture 110. For example, each of outside tabs 150, 160, 170, and 180 may be located 15 inches from center of aperture 110. The distance of the second circular pattern created by outside tabs 150, 160, 170, and 180 may be determined by the second distance measured from the center of the aperture 110. For example, outside tabs 150, 160, 170, and 180 may be located 15 inches from the center of aperture 110, creating a second circular pattern with a diameter of 30 inches.

Within the second circular pattern, each outside tab 150, 160, 170, and 180 may be symmetrically spaced. The radial distance between each individual tab 150, 160, 170, and 180 may depend on the distance the tabs are located from the center of aperture 110. For example, a second circular pattern with a larger diameter may mean that the tabs are further apart from each other and a second circular pattern with a smaller diameter may mean that the tabs are closer together. For example, in a preferred embodiment, a second circular pattern may have a diameter of 30 inches, and each outside tab 150, 160, 170, and 180 may be located 15 inches from the center of aperture 110. Outside tab 150 may be located a radial distance of 7.5 inches from outside tab 160, which may be located a radial distance of 7.5 inches from outside tab 170, which may be located a radial distance of 7.5 inches from outside tab 180, which may be located a radial distance of 7.5 inches from outside tab 150. As another example, a second circular pattern may have a diameter of 40 inches, and each outside tab 150, 160, 170, and 180 may be located 20 inches from the center of aperture 110. Outside tab 150 may be located a radial distance of 10 inches from outside tab 160, which may be located a radial distance of 10 inches from outside tab 170, which may be located a radial distance of 10 inches from outside tab 180, which may be located a radial distance of 10 inches from outside tab 150.

Inside tabs 145, 155, 165, and 175 may be located a fixed radial distance from outside tabs 150, 160, 170, and 180. For example, a first circular pattern may have a diameter of 24 inches and a second circular pattern may have a diameter of 30 inches. Inside tab 145 may be a radial distance of 6 inches from outside tab 150, inside tab 155 may be a radial distance of 6 inches from outside tab 160, inside tab 165 may be a radial distance of 6 inches from outside tab 170, and inside tab 175 may be a radial distance of 6 inches from outside tab 180. In FIG. 1C, inside tabs 145, 155, 165, and 175 may be aligned with outside tabs 150, 160, 170, and 180. In another embodiment, inside tabs 145, 155, 165, and 175 may not be aligned with outside tabs 150, 160, 170, and 180.

In other embodiments, inside tabs 145, 155, 165, and 175 may be arranged in a square, rectangular, or other type of pattern. In other embodiments, inside tabs 145, 155, 165, and 175 may not be symmetrically spaced within the first circular pattern. For example, inside tab 145 may be located a radial distance of 5 inches from inside tab 155, which may be located a radial distance of 2 inches from inside tab 165, which may be located a radial distance of 7 inches from inside tab 175, which may be located a radial distance of 10 inches from inside tab 145.

In other embodiments, outside tabs 150, 160, 170, and 180 may be arranged in a square, rectangular, or other type of pattern. In other embodiments, outside tabs 150, 160, 170, and 180 may not be symmetrically spaced within the second circular pattern. For example, outside tab 150 may be located a radial distance of 10 inches from outside tab 160, which may be located a radial distance of 5 inches from outside tab 170, which may be located a radial distance of 9 inches from outside tab 180, which may be located a radial distance of 6 inches from outside tab 150.

The dimensions of a first circular pattern formed by inside tabs 145, 155, 165, and 175 may correspond to a connecting drain basin. For example, the first circular pattern may have a diameter of 24 inches. An outside diameter of a drain basin may have an outside diameter of 24 inches. Inside tabs 145, 155, 165, and 175 may connect with the drain basin.

The dimensions of a second circular pattern formed by outside tabs 150, 160, 170, and 180 may correspond to a connecting drain basin. For example, the second circular pattern may have a diameter of 30 inches. An outside diameter of a drain basin may have an outside diameter of 30 inches. Outside tabs 150, 160, 170, and 180 may connect with the drain basin.

Figure 2A:
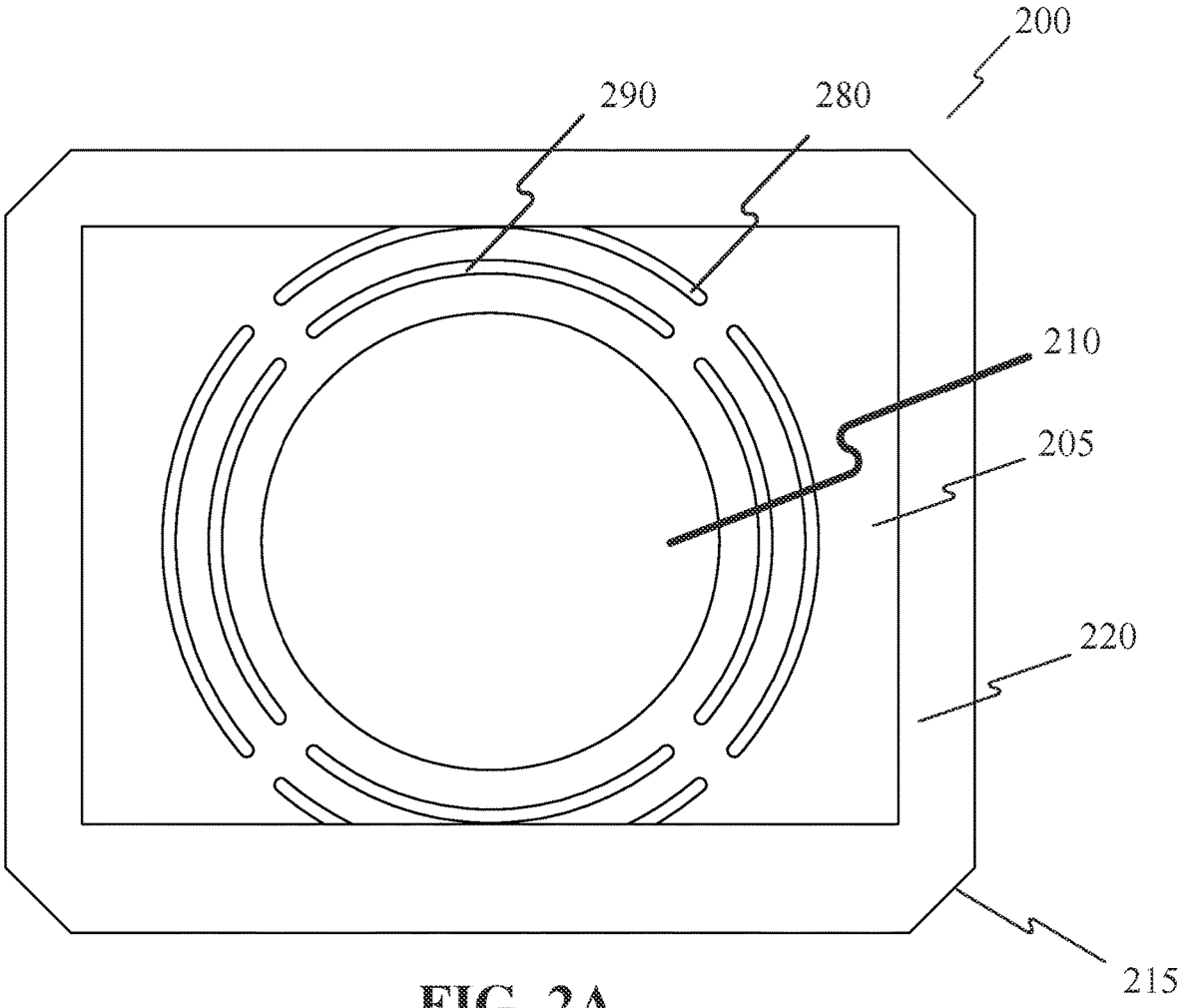
FIG. 2A depicts a top view of a base plate with three sets of tabs, consistent with various embodiments of the present disclosure.

FIG. 2A depicts a top view of a base plate with three sets of tabs, consistent with various embodiments of the present disclosure. Base plate 200 may include a flat surface 205 and aperture 210. Aperture 210 may be a circular shape or any other shaped opening. Aperture 210 may be located in the center, left, or right side of flat surface 205. In some embodiments, base plate 200 may be constructed of ductile iron, plastic and/or any other suitable material. Metal embodiments of base plate 200 may be formed, for example, through casting, molding, sheet metal forming, or any other suitable means. In some embodiments, plate 200 is configured to support structural loads, such as dead and live loads resulting from earthen embankments, surface loads, parking lots, structures, vehicular loads, including, for example, the American Association of State Highway and Transportation Officials (AASHTO) H-20 loading criteria, and/or walking loads. The thickness or gauge of plate 200 may be determined by the structural load bearing requirements needed for the particular plate. Base plate 200 may include concentric rings 280 and 290, described in further detail below. Base plate 100 may be painted black and/or any other color.

In some embodiments, base plate 200 may include a flange 220. Flange 220 may include a chamfered edge 215. Flat surface 205 may also include concentric rings 280 and 290.

Figure 2B:
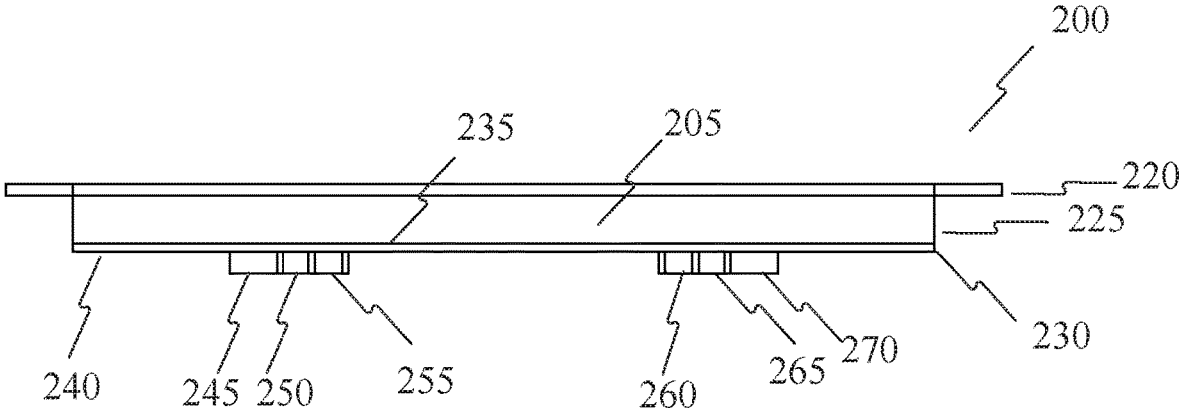
FIG. 2B depicts a side view of a base plate with three sets of tabs, consistent with various embodiments of the present disclosure.

FIG. 2B depicts a base plate 200 viewed from the side. Plate 200 may include an outside edge 230 and a raised lip 225 may surround the outside edge 230. Raised lip 225 may extend upward from the outside edge 230. Raised lip 225 may connect with a flange 220. Flange 220 may extend in a horizontal direction away from raised lip 225. Flange 220 may be configured to define a relatively flat surface for receiving an inlet casting. Flange 220 may include chamfered edge 215, shown in FIG. 2A. Chamfered edge 215 may help further define flange 220 for receiving an inlet casting.

Flat surface 205 may include a topside 235 and an underside 240. Plate 200 may include tabs, 245, 250, 255, 260, 265, and 270 that may be located on the underside 240 of plate 200. Additionally, plate 200 may include tabs 291, 292, 293, 295, 296, and 294, shown in FIG. 2C. Tabs 245, 250, 255, 260, 265, and 270 may project downward relative to the underside 240 of plate 200. Tabs 245, 250, 255, 260, 265, and 270 may all have the same width and length or may have different lengths and widths.

Figure 2C:
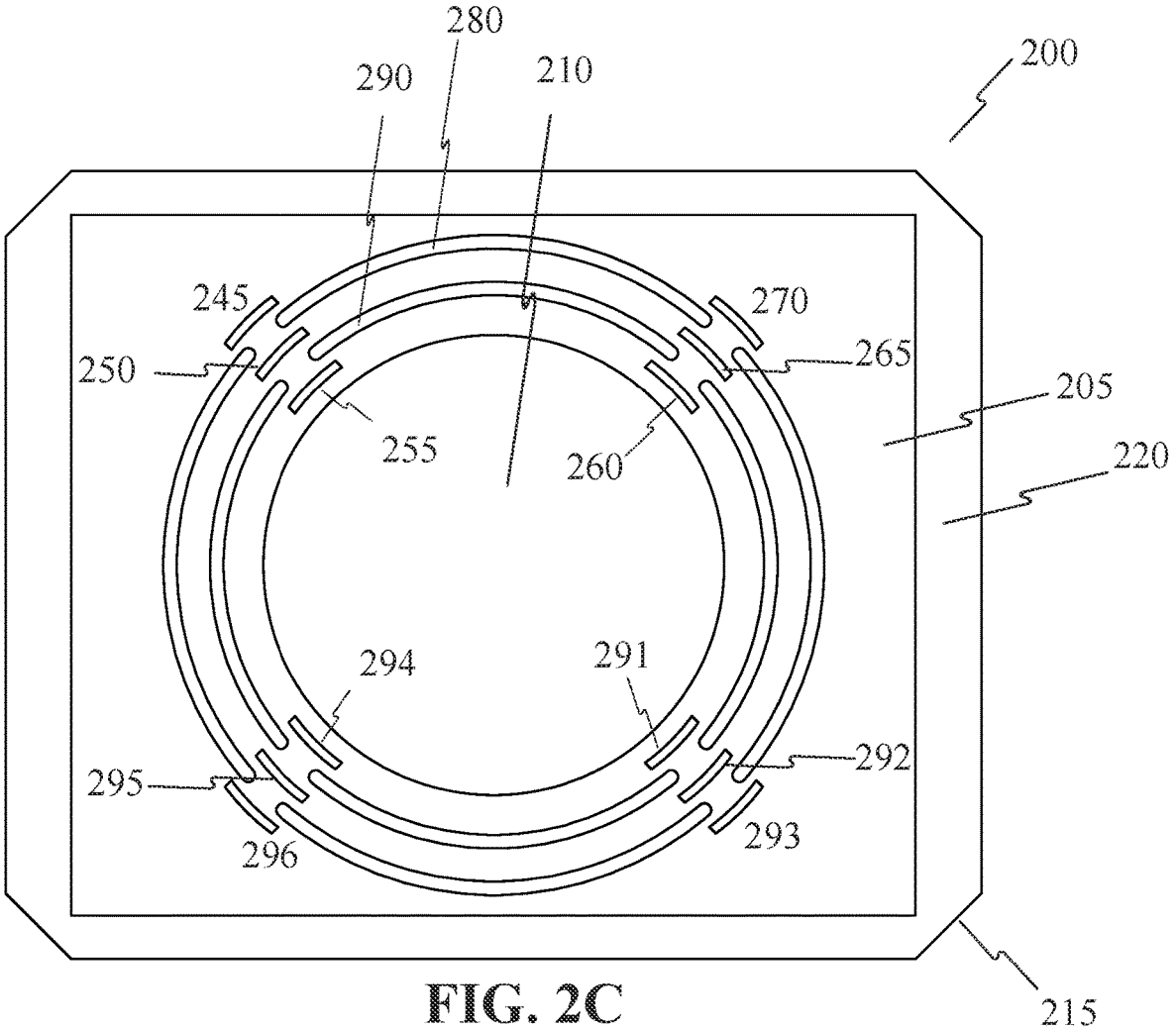
FIG. 2C depicts a bottom view of a base plate with three sets of tabs, consistent with various embodiments of the present disclosure.

FIG. 2C depicts a base plate 200 flipped upside down and viewed from the bottom. As shown in FIG. 2C, one embodiment of base plate 200 includes three sets of tabs. In another embodiment, base plate 200 may include 4, 5, 6, or any number of sets of tabs. A set of inside tabs may be comprised of four individual tabs 255, 260, 291 and 294. Inside tabs 255, 260, 291 and 294 may be arranged in a first circular pattern around aperture 210 on underside 240 of flat surface 205. A set of middle tabs may be comprised of four individual tabs 250, 265, 292, and 295. Middle tabs 250, 265, 292, and 295 may be arranged in a second circular pattern around aperture 210 on underside 240 of flat surface 205. A set of outside tabs may be comprised of four individual tabs 245, 270, 293, and 296. Outside tabs 245, 270, 293, and 296 may be arranged in a third circular pattern around aperture 210 on underside 240 of flat surface 205.

Inside tabs 255, 260, 291 and 294 may each be located at a first distance measured from the center of aperture 210. For example, each inside tab 255, 260, 291 and 294 may be located 12 inches from center of aperture 210. The distance of the first circular pattern created by inside tabs 255, 260, 291, and 294 may be determined by the first distance measured from the center of aperture 210. For example, inside tabs 255, 260, 291, and 294 may be located 12 inches from center of aperture 210, creating a first circular pattern with a diameter of 24 inches.

Within the first circular pattern, each inside tab 255, 260, 291, and 294 may be symmetrically spaced. The radial distance between each individual inside tab 255, 260, 291, and 294 may depend on the distance the tabs are located from the center of aperture 210. F or example, a first circular pattern with a larger diameter may mean that the tabs are further apart from each other and a first circular pattern with a smaller diameter may mean that the tabs are closer together. For example, in a preferred embodiment, a first circular pattern may have a diameter of 24 inches, and each inside tab 255, 260, 291, and 294 may be located 12 inches from the center of aperture 210. Inside tab 255 may be located a radial distance of 6 inches from inside tab 260, which may be located a radial distance of 6 inches from inside tab 291, which may be located a radial distance of 6 inches from inside tab 294, which may be located a radial distance of 6 inches from inside tab 255. As another example, a first circular pattern may have a diameter of 20 inches, and each inside tab 255, 260, 291, and 294 may be located 10 inches from the center of aperture 110. Inside tab 255 may be located a radial distance of 5 inches from inside tab 260, which may be located a radial distance of 5 inches from inside tab 291, which may be located a radial distance of 5 inches from inside tab 294, which may be located a radial distance of 5 inches from inside tab 255.

Middle tabs 250, 265, 292, and 295 may each be located at a second distance measured from the center of aperture 210. For example, each middle tab 250, 265, 292, and 295 may be located 15 inches from center of aperture 210. The distance of the second circular pattern created by middle tabs 250, 265, 292, and 295 may be determined by the second distance measured from the center of the aperture 210. For example, middle tabs 250, 265, 292, and 295 may be located 15 inches from center of aperture 210, creating a second circular pattern with a diameter of 30 inches, Within the second circular pattern, each outside tab 250, 265, 292, and 295 may be symmetrically spaced. The radial distance between each individual middle tab 250, 265, 292, and 295 may depend on the distance the tabs are located from the center of aperture 210. For example, a second circular pattern with a larger diameter may mean that the tabs are further apart from each other and a second circular pattern with a smaller diameter may mean that the tabs are closer together. For example, in a preferred embodiment, a second circular pattern may have a diameter of 30 inches, and each middle tab 250, 265, 292, and 295 may be located fifteen inches from the center of aperture 210. Middle tab 250 may be located a radial distance of 7.5 inches from middle tab 265, which may be located a radial distance of 7.5 inches from middle tab 292, which may be located a radial distance of 7.5 inches from middle tab 295, which may be located a radial distance of 7.5 inches from middle tab 250. As another example, a second circular pattern may have a diameter of forty inches, and each middle tab 250, 265, 292, and 295 may be located 20 inches from the center of aperture 210. Middle tab 250 may be located a radial distance of 10 inches from middle tab 265, which may be located a radial distance of 10 inches from middle tab 292, which may be located a radial distance of 10 inches from middle tab 295, which may be located a radial distance of 20 inches from middle tab 250.

Outside tabs 245, 270, 293, and 296 may each be located at a third distance measured from the center of aperture 210. For example, each outside tab 245, 270, 293, and 296 may be located 18 inches from center of aperture 210. The distance of the third circular pattern created by outside tabs 245, 270, 293, and 296 may be determined by a third distance measured from the center of aperture 210. For example, outside tabs 245, 270, 293, and 296 may be located 18 inches from center of aperture 210, creating a third circular pattern with a diameter of 36 inches.

Within the third circular pattern, each outside tab 245, 270, 293, and 296 may be symmetrically spaced. The radial distance between each individual outside tab 245, 270, 293, and 296 may depend on the distance the tabs are located from the center of aperture 210. For example, a third circular pattern with a larger diameter may mean that the tabs are further apart from each other and a third circular pattern with a smaller diameter may mean that the tabs are closer together. For example, in a preferred embodiment, a second circular pattern may have a diameter of 36 inches, and each outside tab 245, 270, 293, and 296 may be located 18 inches from the center of aperture 210. Outside tab 245 may be located a radial distance of 9 inches from outside tab 270, which may be located a radial distance of 9 inches from outside tab 293, which may be located a radial distance of 9 inches from outside tab 296, which may be located a radial distance of 9 inches from outside tab 245. As another example, a third circular pattern may have a diameter of 60 inches, and each outside tab 245, 270, 293, and 296 may be located 30 inches from the center of aperture 210. Outside tab 245 may be located a radial distance of 15 inches from outside tab 270, which may be located a radial distance of 15 inches from outside tab 293, which may be located a radial distance of 15 inches from outside tab 296, which may be located a radial distance of 15 inches from outside tab 245.

In other embodiments, inside tabs 255, 260, 291, and 294 may be arranged in a square, rectangular, or other type of pattern. In other embodiments, inside tabs 255, 260, 291 and 294 may not be symmetrically spaced within the first circular pattern. For example, inside tab 255 may be located a radial distance of 5 inches from inside tab 260, which may be located a radial distance of 7 inches from inside tab 291, which may be located a radial distance of 9 inches from inside tab 294, which may be located a radial distance of 2 inches from inside tab 255.

In other embodiments, middle tabs 250, 265, 292, and 295 may be arranged in a square, rectangular, or other type of pattern. In other embodiments, middle tabs 250, 265, 292, and 295 may not be symmetrically spaced within the second circular pattern. For example, middle tab 250 may be located a radial distance of 5 inches from middle tab 265, which may be located a radial distance of 9 inches from middle tab 292, which may be located a radial distance of 10 inches from middle tab 295, which may be located a radial distance of 6 inches from middle tab 250.

In other embodiments, outside tabs 245, 270, 293, and 296 may be arranged in a square, rectangular, or other type of pattern. In other embodiments, outside tabs 245, 270, 293, and 296 may not be symmetrically spaced within the third circular pattern. For example, outside tab 245 may be located a radial distance of 6 inches from outside tab 270, which may be located a radial distance of 8 inches from outside tab 293, which may be located a radial distance of 4 inches from outside tab 296, which may be located a radial distance of 18 inches from outside tab 245.

The dimensions of the first circular pattern formed by inside tabs 255, 260, 291, and 294 may correspond to a connecting drain basin. For example, the first circular pattern may have a diameter of 24 inches. An outside diameter of a drain basin may have an outside diameter of 24 inches. Inside tabs 255, 260, 291, and 294 may connect with the drain basin.

The dimensions of a second circular pattern formed by middle tabs 250, 265, 292, and 295 may correspond to a connecting drain basin. For example, the second circular pattern may have a diameter of 30 inches. An outside diameter of a drain basin may have an outside diameter of 30 inches. Middle tabs 250, 265, 292, and 295 may connect with the drain basin.

The dimensions of a third circular pattern formed by outside tabs 245, 270, 293, and 296 may correspond to a connecting drain basin. For example, the third circular pattern may have a diameter of 36 inches. An outside diameter of a drain basin may have an outside diameter of 36 inches. Outside tabs 245, 270, 293, and 296 may connect with the drain basin.

Concentric rings 280 and 290 may provide an opening to receive a drain basin. An installer may cut the gap space between the ring outlines to create the opening for a drain basin so a drain basin may fit within a ring and abut the set of tabs. Concentric rings 280 and 290 may provide a template for cutting the remaining portion of flat surface 205. For example, concentric ring 290 may be cut to form a complete opening. A drain basin may be connected to middle tabs 250, 265, 292, and 295. A top of a drain basin may go into concentric ring 290. As another example, concentric ring 280 may be cut to form a complete opening. A drain basin may be connected to outside tabs 245, 270, 293, and 296. A top of a drain basin may go into concentric ring 280.

Figure 3:
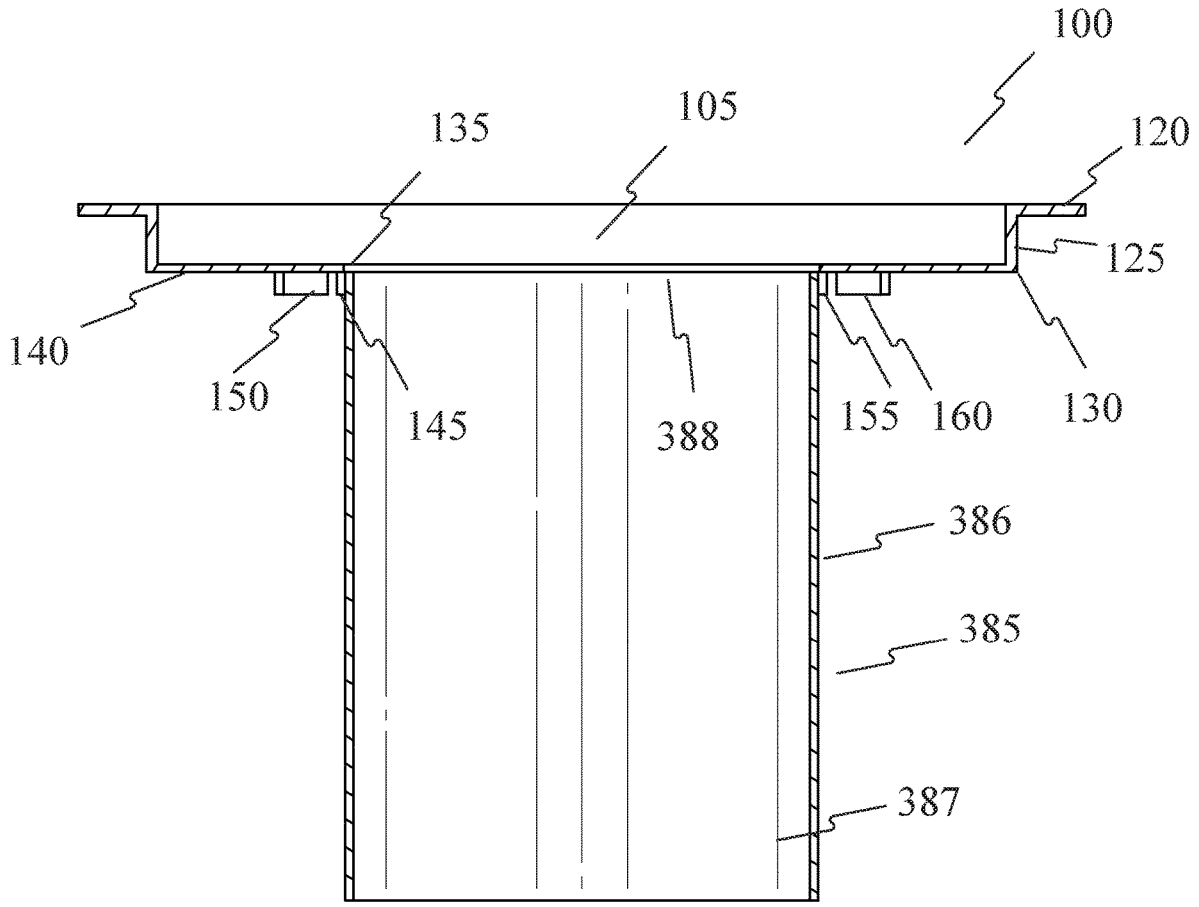
FIG. 3 depicts a side view of a base plate with two sets of tabs and a drain basin connected to an inner set of tabs, consistent with various embodiments of the present disclosure.

FIG. 3 depicts a side view of drain basin 385 connected to base plate 100. Base plate 100 may include tabs 145, 150, 155, and 160. Tabs 145 and 155 may be a part of a set of inside tabs. Tabs 165 and 175, shown in FIG. 1C, may also be a part of a set of inside tabs. Tabs 150 and 160 may be a part of a set of outside tabs. Tabs 170 and 180, shown in FIG. 1C, may also be a part of a set of outside tabs. Drain basin 385 may have a tubular body 386 with an inner cavity 387 and a top end 388. In some embodiments, drain basin 385 may connect with inside tabs 145 and 155, and inside tabs 175 and 165, shown in FIG. 1C. The connection may be a snap fit, friction fit, hook and closure, bayonet connection, or other types of connections. Inside tabs 145, 155, 175, and 165 may act as a guide to seat base plate 100 on the top end 388 of drain basin 385.

In some embodiments, the inner diameter of the first circular pattern of the inside tabs 145, 155, 165, and 175 may fit an outside diameter of a 24-inch drain basin. For example, in FIG. 3, drain basin 385 may have an outside diameter of 24 inches. Drain basin 385 may connect with inside tabs 145, 155, 165, and 175 so that the inside tabs hold the drain basin in place.

Figure 4:
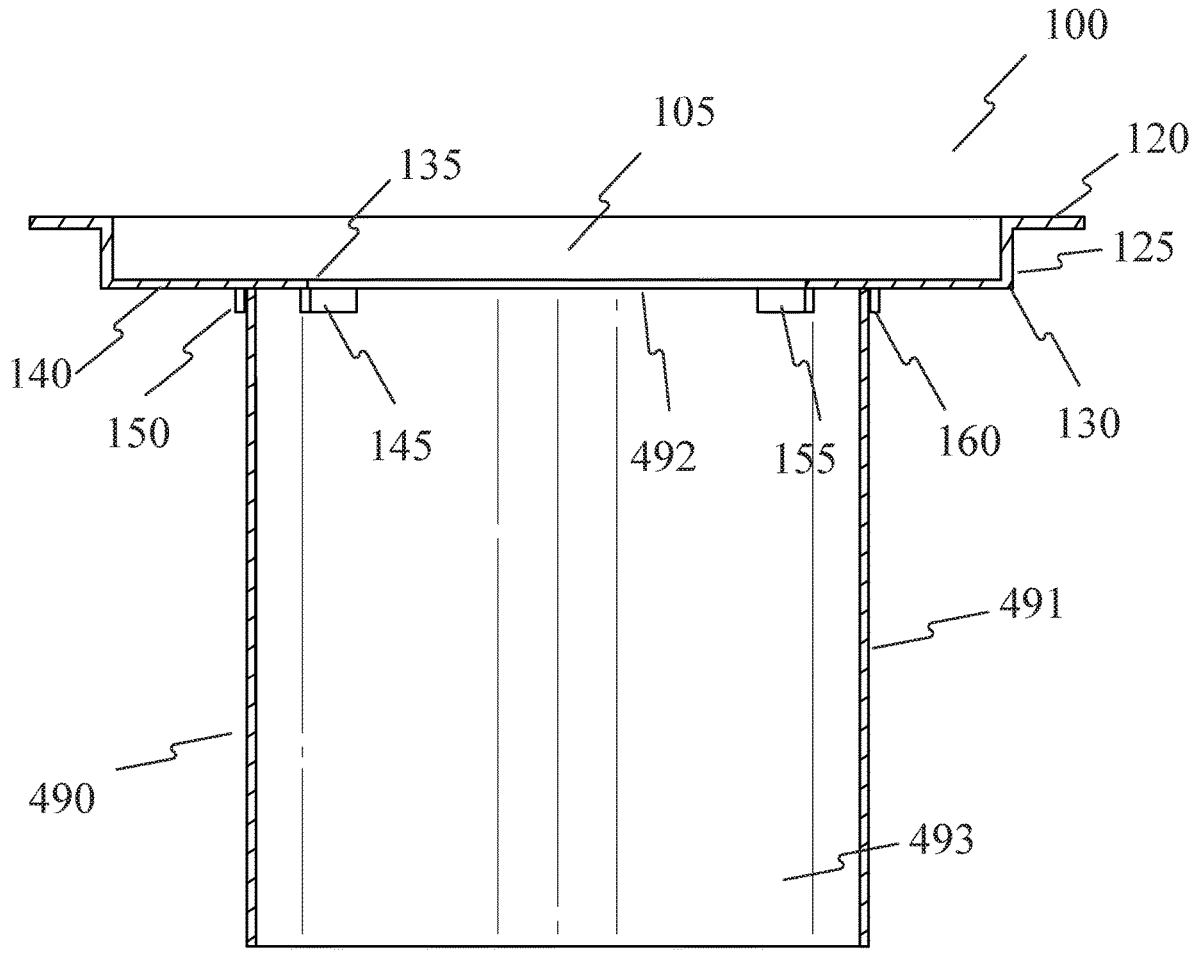
FIG. 4 depicts a side view of a base plate with two sets of tabs and a drain basin connected to an outer set of tabs, consistent with various embodiments of the present disclosure.

FIG. 4 depicts a side view of drain basin 490 connected to base plate 100. Base plate 100 may include tabs 145, 150, 155, and 160. Tabs 145 and 155 may be a part of a set of inside tabs. Tabs 165 and 175, shown in FIG. 1C, may also be a part of a set of inside tabs. Tabs 150 and 160 may be a part of a set of outside tabs. Tabs 170 and 180, shown in FIG. 1C, may also be a part of a set of outside tabs. Drain basin 490 may have a tubular body 491 with an inner cavity 493 and a top end 492. In some embodiments, drain basin 490 may connect with outside tabs 150 and 160, and outside tabs 170 and 180, shown in FIG. 1C. The connection may be a snap fit, friction fit, hook and closure, bayonet connection, or other types of connections. Outside tabs 150, 160, 170, and 180 may act as a guide to seat base plate 100 on the top end 492 of drain basin 490.

In some embodiments, the inner diameter of the second circular pattern of the outside tabs 150, 160, 170, and 180 may fit an outside diameter of a 30-inch drain basin. For example, in FIG. 4, drain basin 490 may have an outside diameter of 30 inches. Drain basin 490 may connect with outside tabs 150, 160, 170, and 180 so that the outside tabs hold the drain basin in place.

Figure 5:
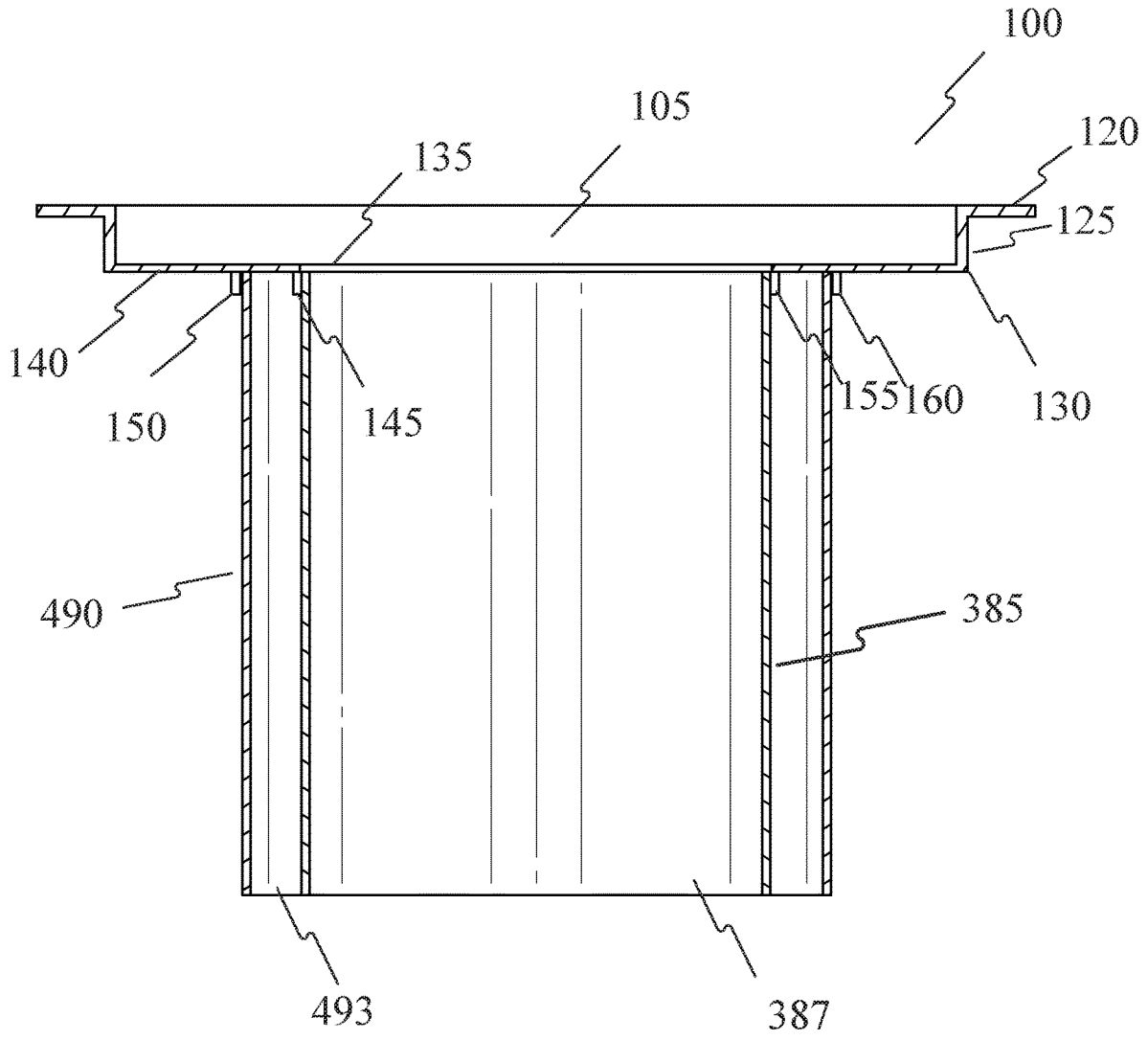
FIG. 5 depicts a side view of a base plate with two sets of tabs and a drain basin connected to an inner set of tabs and a drain basin connected to an outer set of tabs, consistent with various embodiments of the present disclosure.

FIG. 5 depicts a side view of base plate 100 with drain basin 490 and drain basin 385. This embodiment shows how base plate 100 may accommodate different sized drain basins. Inner tabs 145 and 155, and inner tabs 165 and 175 shown in FIG. 1C, may hold drain basin 485 in place. Drain basin 385 may have an outside diameter of 24 inches. Outer tabs 150 and 160, and outer tabs 170 and 180 shown in FIG. 1C, may hold drain basin 490 in place. Drain basin 490 may have an outside diameter of 30 inches.

Figure 6:
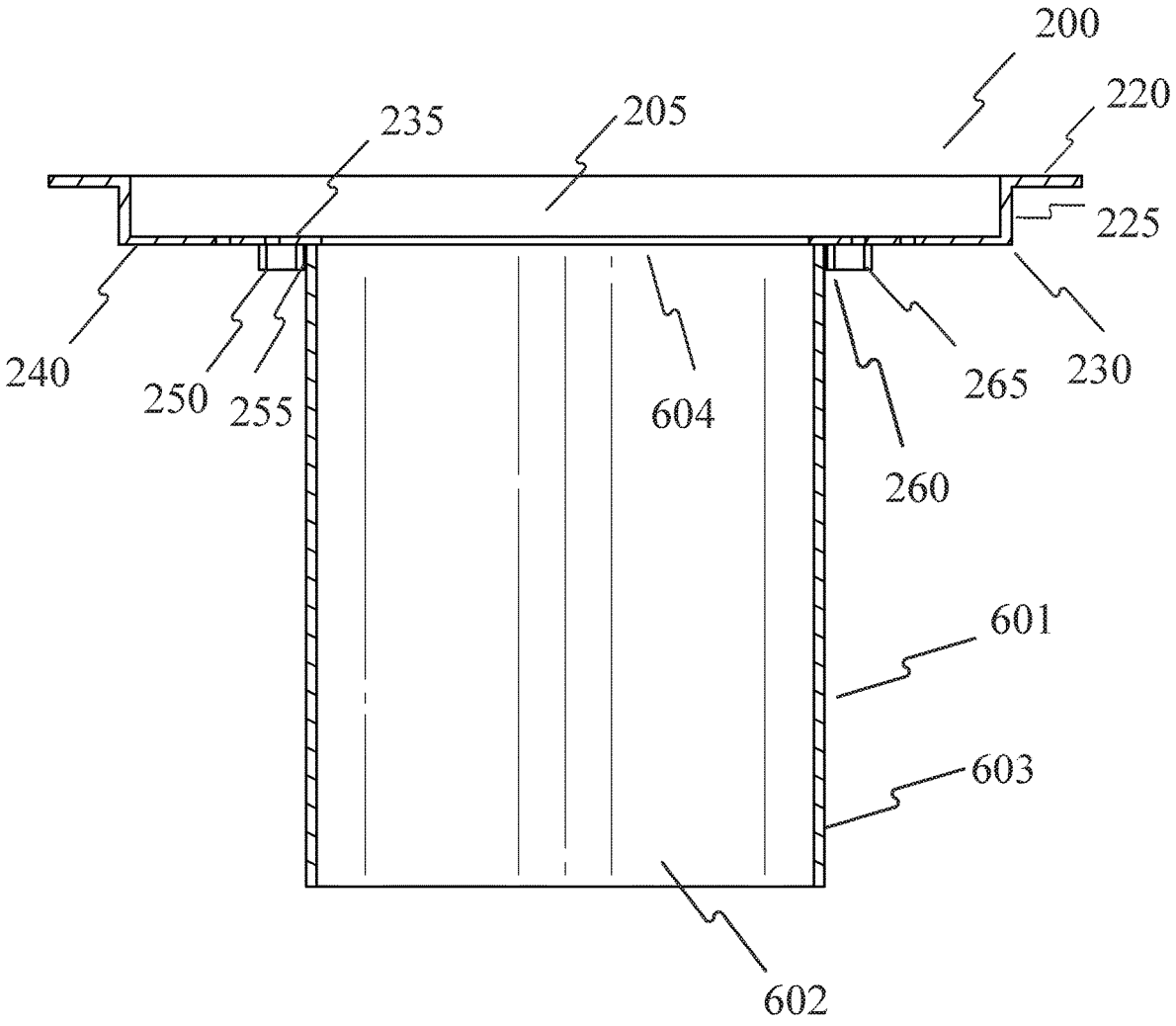
FIG. 6 depicts a side view of a base plate with three sets of tabs and a drain basin connected to an inner set of tabs, consistent with various embodiments of the present disclosure.

FIG. 6 depicts a side view of drain basin 601 connected to base plate 200. Base plate 200 may include tabs 250, 255, 260, and 265. Tabs 255 and 260 may be a part of a set of inside tabs. Tabs 291 and 294, shown in FIG. 2C, may also be a part of a set of inside tabs. Tabs 250 and 265 may be a part of a set of middle tabs. Tabs 292 and 295, shown in FIG. 2C, may also be a part of a set of middle tabs. Base plate 200 may also include a set of outside tabs, not shown in FIG. 6. Exemplary outside tabs 245, 270, 293, and 295 are shown in FIG. 2C. Drain basin 601 may have a tubular body 603 with an inner cavity 602 and a top end 604. In some embodiments, drain basin 201 may connect with inside tabs 255 and 260, and inside tabs 291 and 294, as shown in FIG. 2C. The connection may be a snap fit, friction fit, hook and closure, bayonet connection, or other types of connections. Inside tabs 250, 255, 260, and 265 may act as a guide to seat base plate 200 on the top end 604 of drain basin 601.

In some embodiments, the inner diameter of the first circular pattern of the inside tabs 255, 260, 291, and 294 may fit an outside diameter of a 24-inch drain basin. For example, drain basin 601, as shown in FIG. 6, may have an outside diameter of 24 inches. Drain basin 601 may connect with inside tabs 255, 260, 291, and 294 so that the inside tabs hold drain basin 601 in place.

Figure 7:
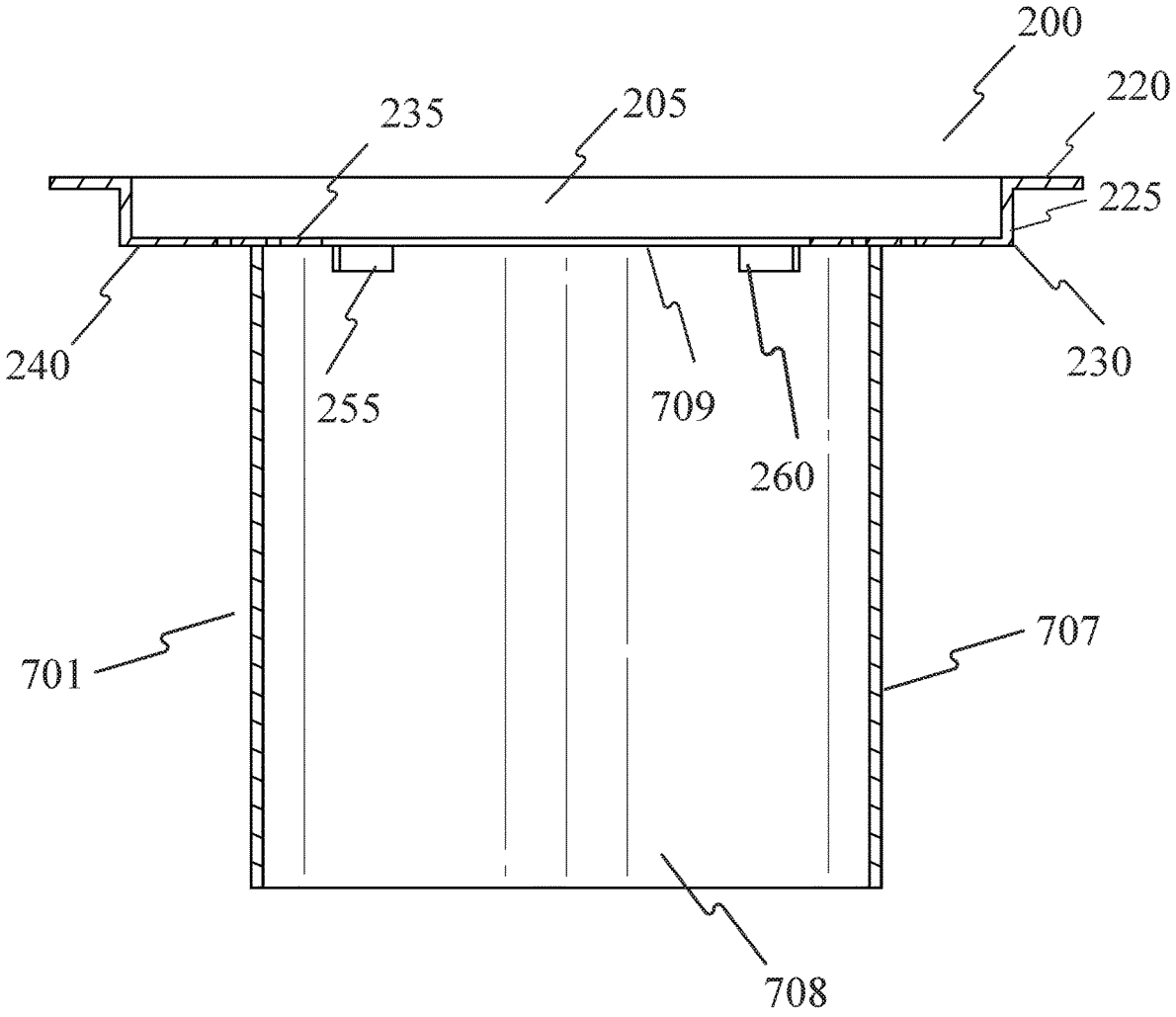
FIG. 7 depicts a side view of a base plate with three sets of tabs and a drain basin connected to a middle set of tabs, consistent with various embodiments of the present disclosure.

FIG. 7 depicts a side view of drain basin 701 connected to base plate 200. Base plate 200 may include tabs 255 and 260. Tabs 255 and 260 may be a part of a set of inside tabs. Base plate 200 may also include additional inside tabs, and middle and outside tabs, as shown in FIG. 2C. Drain basin 701 may have a tubular body 707 with an inner cavity 708 and a top end 709. In some embodiments, drain basin 701 may connect with middle tabs 250, 265, 292, and 295, shown in FIG. 2C. The connection may be a snap fit, friction fit, hook and closure, bayonet connection, or other types of connections. Middle tabs 250, 265, 292, and 295 may act as a guide to seat base plate 200 on the top end 709 of drain basin 707.

In some embodiments, concentric ring 290 may be cut to form a complete opening. Top end 709 of drain basin 701 may fit into the opening of concentric ring 290, shown in FIG. 2C.

In some embodiments, the inner diameter of the second circular pattern of the middle tabs 250, 265, 292, and 295 may fit an outside diameter of a 30-inch drain basin. For example, in FIG. 7, drain basin 701 may have an outside diameter of 30 inches. Drain basin 701 may connect with middle tabs 250, 265, 292, and 295 and may fit into concentric ring 290 so that the middle tabs hold the drain basin in place.

Figure 8:
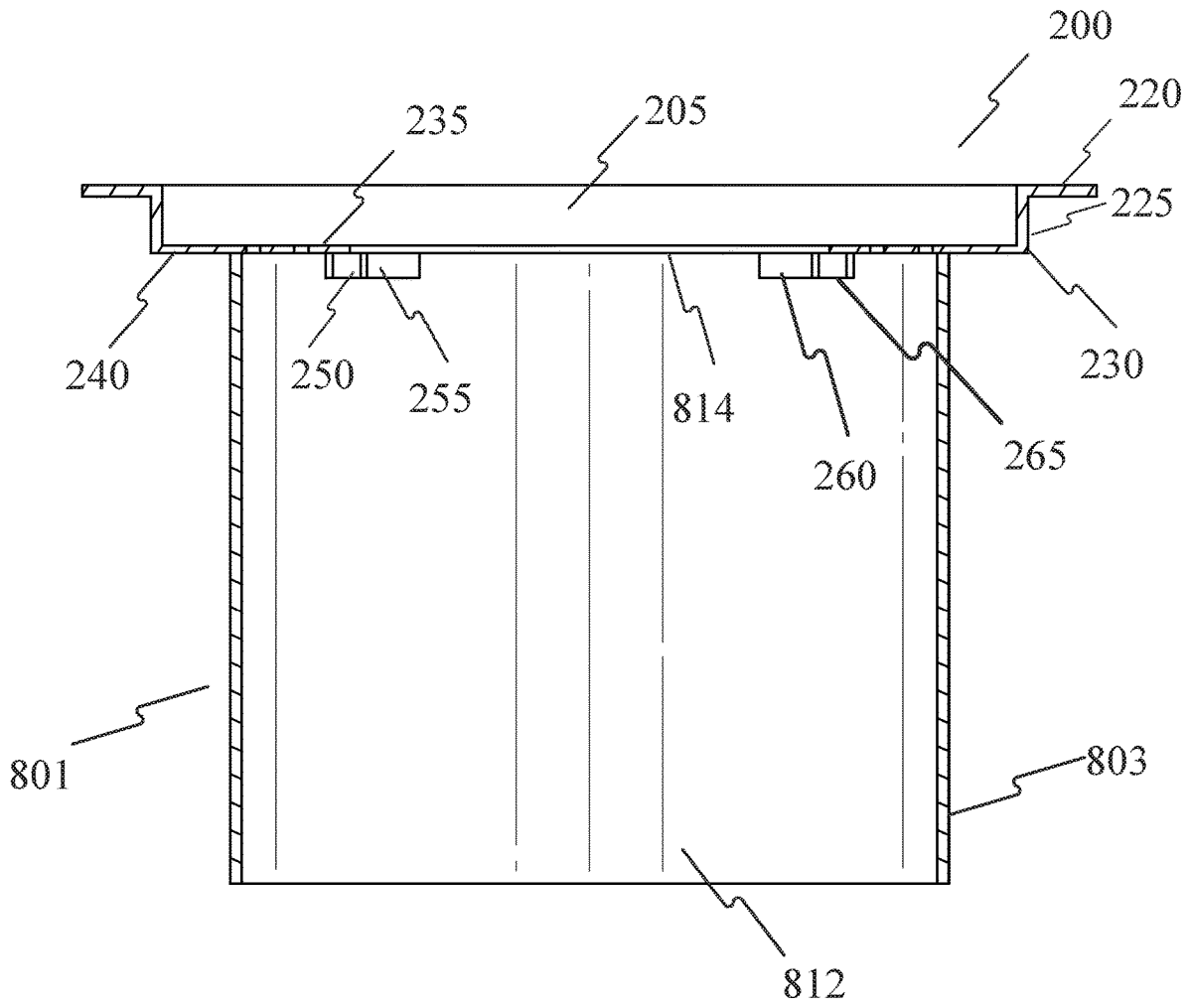
FIG. 8 depicts a side view of a base plate with three sets of tabs and a drain basin connected to an outer set of tabs, consistent with various embodiments of the present disclosure.

FIG. 8 depicts a side view of drain basin 811 connected to base plate 200. Base plate 200 may include tabs 250, 255, 260, and 265. Tabs 255 and 260 may be a part of a set of inside tabs. Tabs 250 and 265 may be a part of a set of middle tabs. Base plate 200 may also include additional inside tabs, and middle and outside tabs, shown in FIG. 2C. Drain basin 801 may have a tubular body 803 with an inner cavity 812 and a top end 814. In some embodiments, drain basin 801 may connect with outside tabs 245, 270, 293, and 296, shown in FIG. 2C. The connection may be a snap fit, friction fit, hook and closure, bayonet connection, or other types of connections. Outside tabs 250, 255, 260, and 265 may act as a guide to seat base plate 200 on the top end 814 of drain basin 801.

In some embodiments, concentric ring 280 may be cut to form a complete opening. Top end 814 of drain basin 801 may fit into the opening of concentric ring 280.

In some embodiments, the inner diameter of the third circular pattern of the outside tabs 245, 270, 293, and 296 may fit an outside diameter of a drain basin. For example, in FIG. 8, drain basin 801 may have an outside diameter of 36 inches. Drain basin 801 may connect with outside tabs 245, 270, 293, and 296 and may fit into concentric ring 280 so that the outside tabs hold the drain basin in place.

Figure 9:
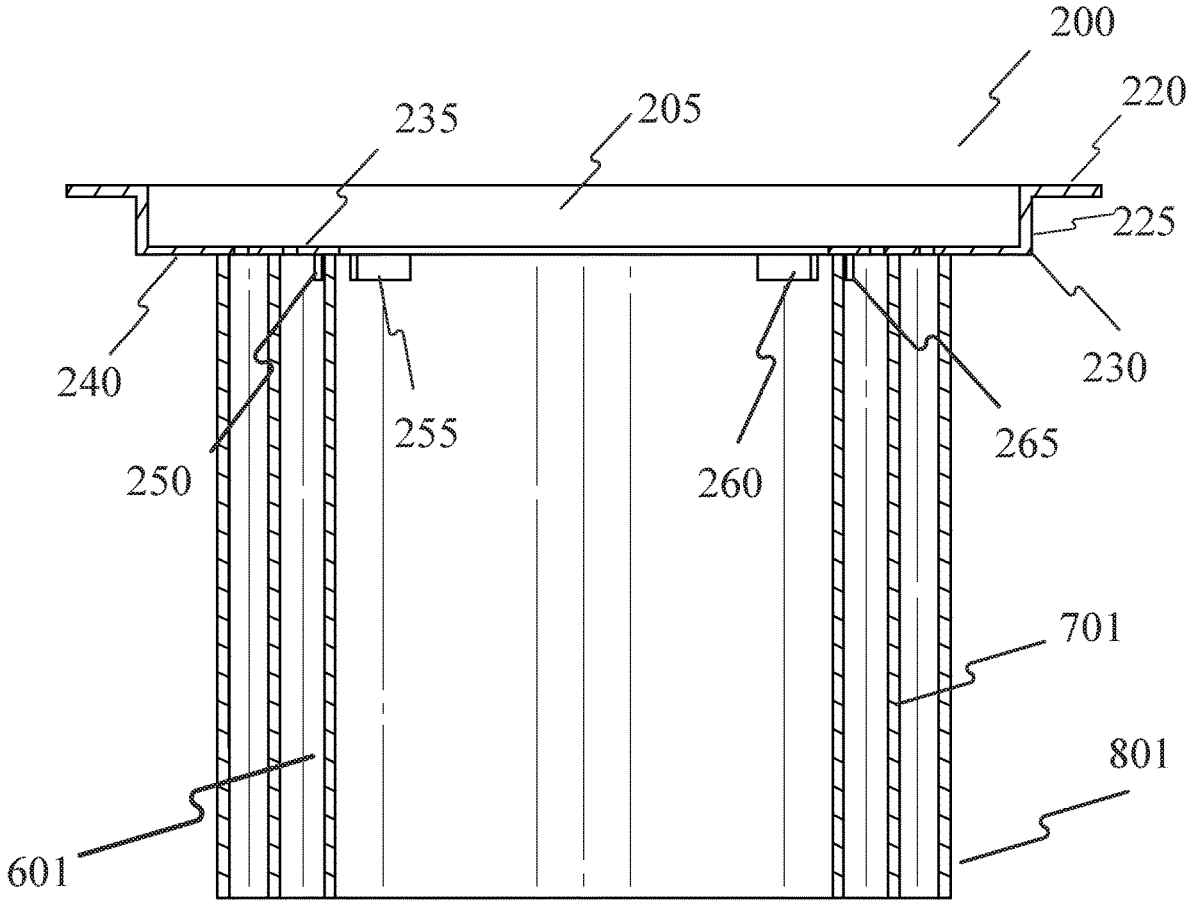
FIG. 9 depicts a side view of a base plate with three sets of tabs and a drain basin connected to an inner set of tabs, a drain basin connected to a middle set of tabs, and a drain basin connected to an outer set of tabs, consistent with various embodiments of the present disclosure.

FIG. 9 depicts a side view of base plate 200 with drain basin 601, drain basin 701, and drain basin 801. This embodiment shows how base plate 200 may accommodate different sized drain basins. Inner tabs 255 and 260, along with inner tabs 291 and 294 shown in FIG. 2C, may hold drain basin 601 in place. Middle tabs 250 and 265, along with middle tabs 292 and 295 shown in FIG. 2C, may hold drain basin 701 in place. Exemplary outside tabs 245, 270, 293, and 296, as shown in FIG. 2C, may hold drain basin 801 in place.

Figure 10:
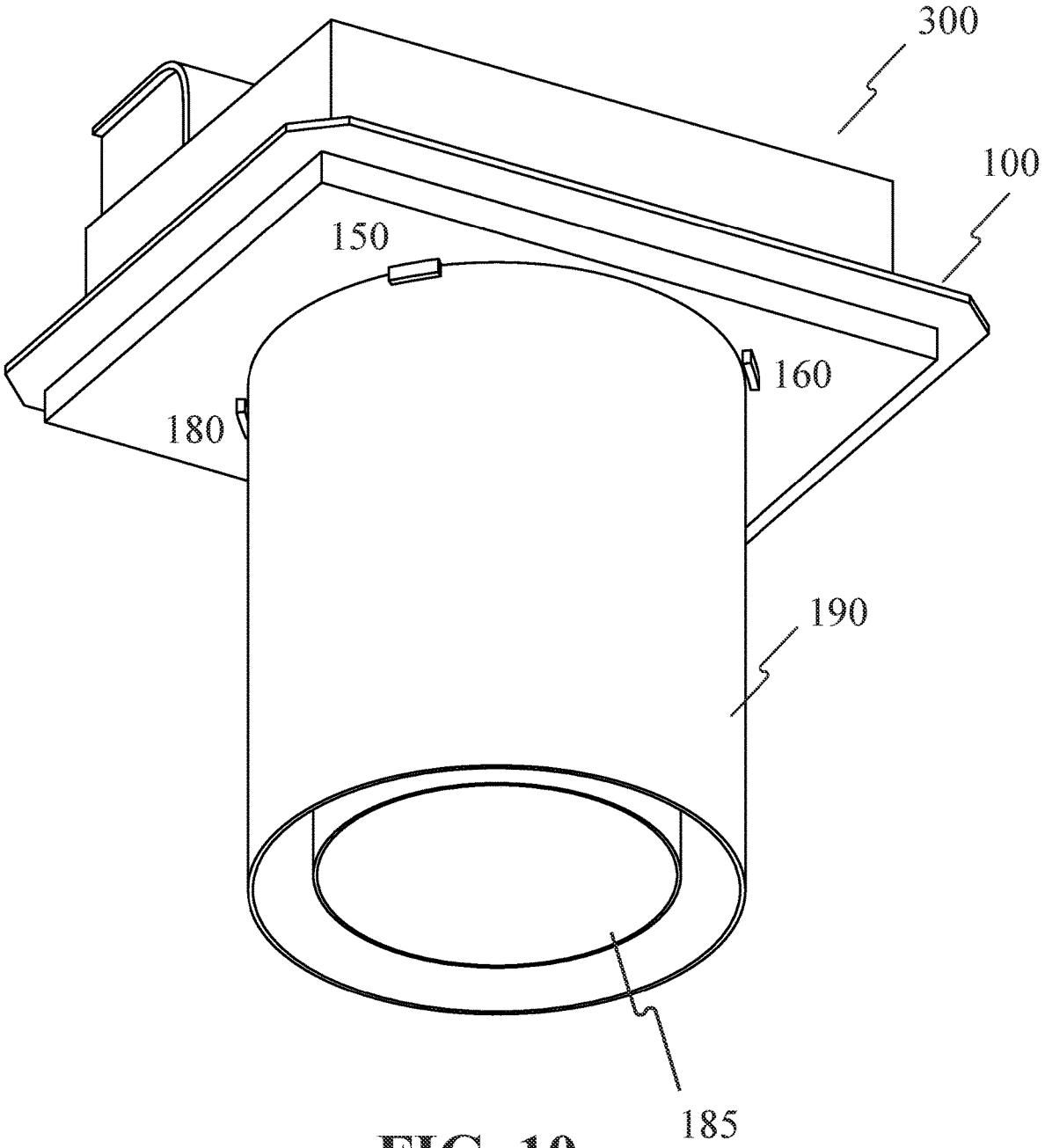
FIG. 10 depicts a perspective view of a fluid runoff system with two sets of tabs, consistent with various embodiments of the present disclosure.

FIG. 10 depicts a perspective view of a fluid runoff system. The fluid runoff system may include an inlet casting 300. Inlet casting 300 may be configured to receive runoff from a surface level drain, curb, or other type of opening. Inlet casting 300 may abut base plate 100. Base plate 100 may include a set of outside tabs 150, 160, and 180. Base plate 100 may also include outside tab 170, as shown in FIG. 1C. Base plate 305 may also include a set of inside tabs 145, 155, 165, and 175, shown in FIG. 1C and FIG. 11. Base plate 100 may accommodate drain basin 185 or drain basin 190, both having different circumferences.

Figure 11:
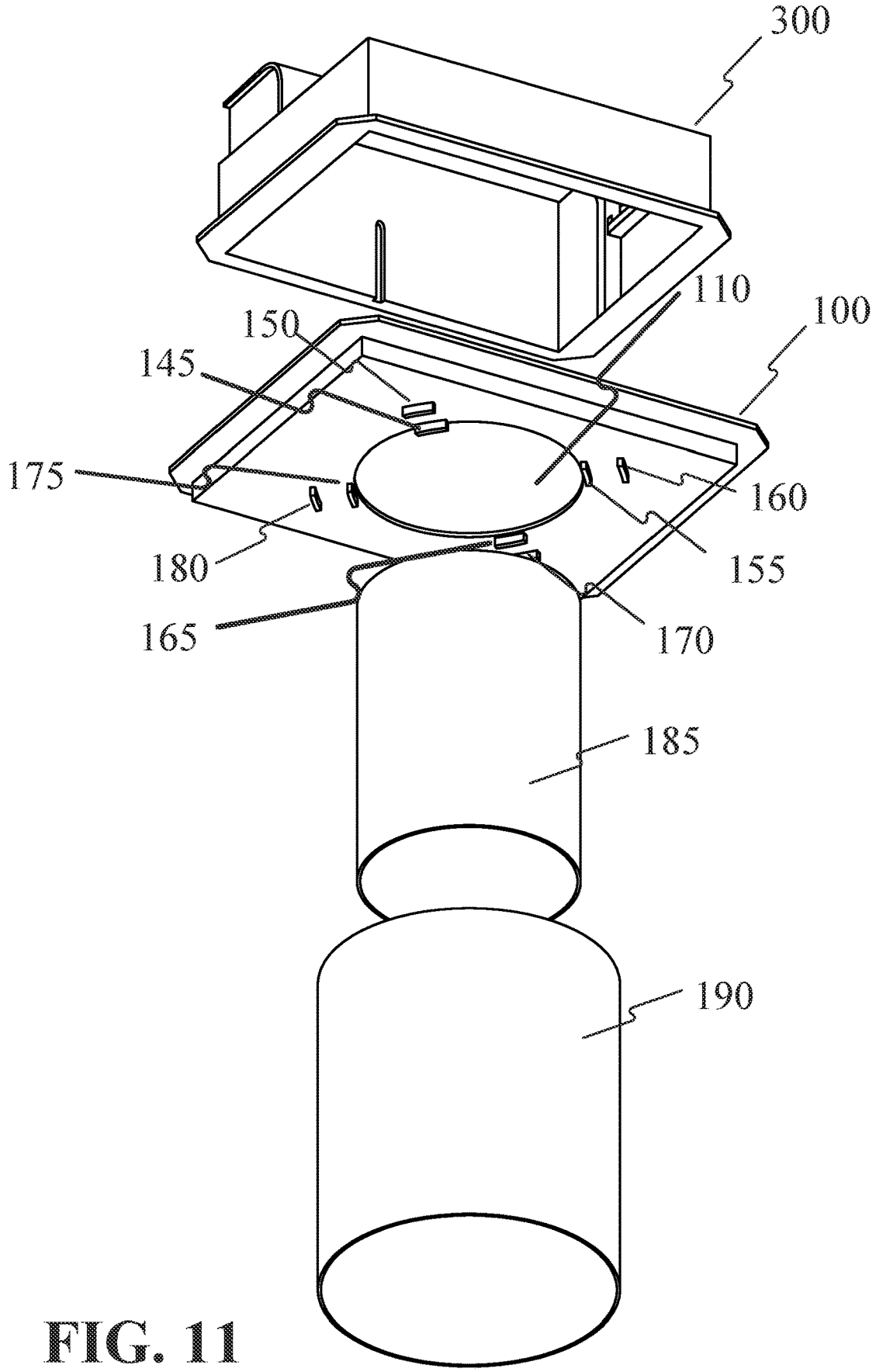
FIG. 11 depicts an expanded perspective view of a fluid runoff system with two sets of tabs, consistent with various embodiments of the present disclosure.

FIG. 11 depicts an expanded perspective view of the fluid runoff system described in FIG. 10. Inside tabs 145, 155, 165, and 175 may connect with drain basin 185. Outside tabs 150, 160, 170, and 180 may connect with drain basin 190.

Figure 12:
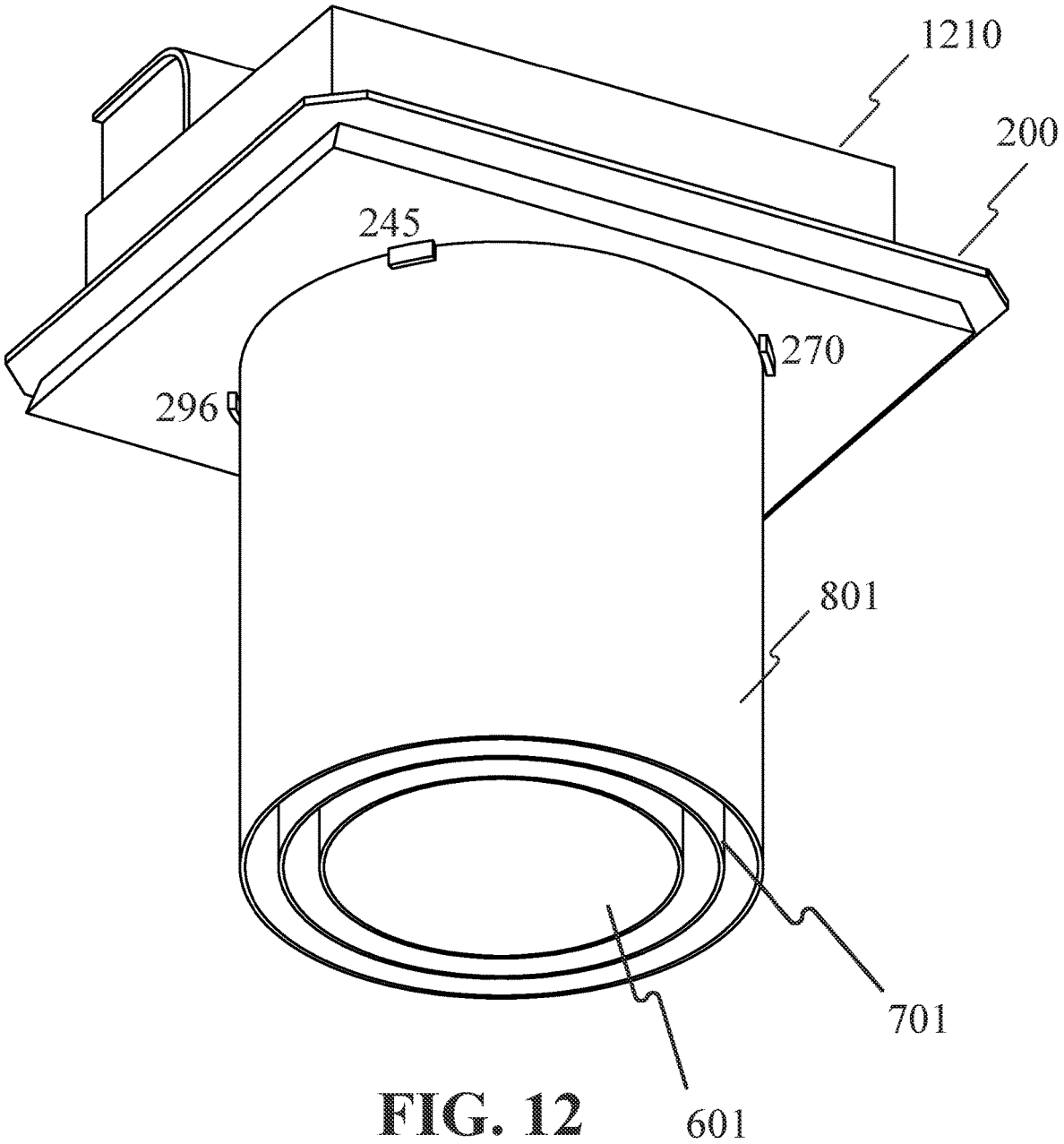
FIG. 12 depicts a perspective view of a fluid runoff system with three sets of tabs, consistent with various embodiments of the present disclosure.

FIG. 12 depicts a perspective view of a fluid runoff system. The fluid runoff system may include an inlet casting 1210. Inlet casting 1210 may be configured to receive runoff from a surface level drain, curb, or other type of opening. Inlet casting 1210 may abut base plate 200. Base plate 200 may include a set of outside tabs 245, 270, and 296. Base plate 200 may also include outside tab 293, shown in FIG. 2C. Base plate 200 may also include a set of inside tabs 255, 260, 291, and 294, shown in FIG. 2C and FIG. 13. Base plate 200 may also include a set of middle tabs 250, 265, 292, and 295, shown in FIG. 2C and FIG. 13. Base plate 200 may accommodate drain basin 601, drain basin 701, or drain basin 801, all having different circumferences.

Figure 13:
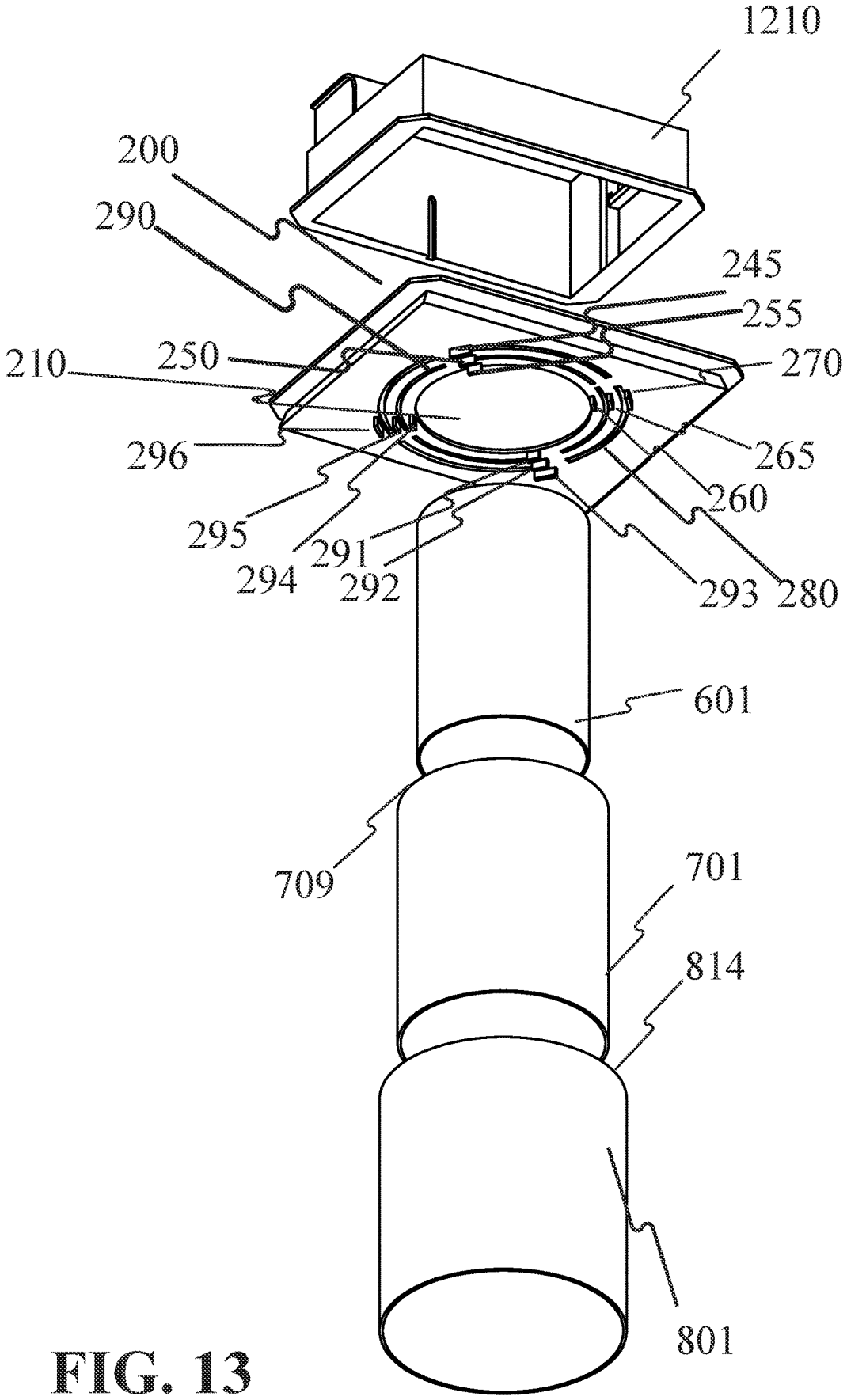
FIG. 13 depicts an expanded perspective view of a fluid runoff system with three sets of tabs, consistent with various embodiments of the present disclosure.

FIG. 13 depicts an expanded perspective view of a fluid runoff system described in FIG. 12. Inside tabs 255, 260, 291, and 294 may connect with drain basin 601. Middle tabs 250, 265, 292, and 295 may connect with drain basin 701. Outside tabs 245, 270, 293, and 296 may connect with drain basin 801.

In some embodiments, top end 814 of drain basin 801 may be placed into concentric ring 280. In other embodiments, the top end 709 and drain basin 701 may be placed into concentric ring 290.

Figure 14:
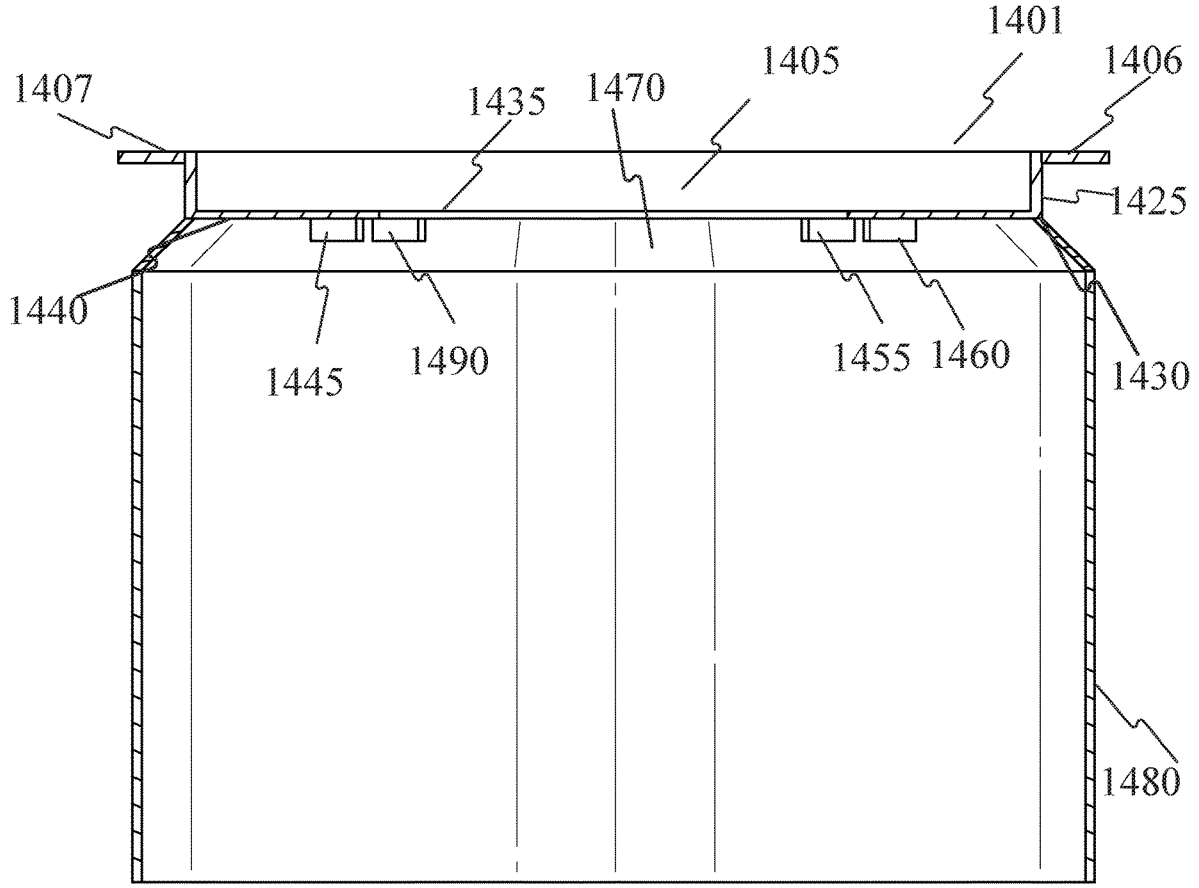
FIG. 14 depicts a side view of a base plate with a reducing plate, consistent with various embodiments of the present disclosure.

FIG. 14 depicts a side view of a base plate with a reducing plate. Base plate 1401 may be comprised of ductile iron. Base plate 1401 may include a flat surface 1405. Flat surface 1405 may have a topside 1435 and an underside 1440. Base plate 1401 may also have an outside edge 1430. Outside edge 1430 may be surrounded by a raised lip 1425. Raised lip 1425 may extend upward from the outside edge. Flange 1406 may extend in a horizontal direction away from raised lip 1425. Flange 1406 may define a relatively flat surface to receive an inlet casting. Flange 1406 may include a chamfered edge. Flat surface 1405 may include four sides, wherein a length of flange 1406, located on one side, is longer than a length of flange 1407, located on the other side.

In some embodiments, base plate 1401 may include one or more sets of tabs. Base plate 1401 may include inside tabs 1490 and 1455. Base plate 1401 may also include additional inside tabs not shown in FIG. 14. Inside tabs may be arranged in a first circular pattern around an aperture of base plate 1401. Each inside tab may be located a first distance equidistant from a center of the aperture. An inner diameter of the first circular pattern may fit an outside diameter of a 24-inch basin. Base plate 1401 may also include outside tabs 1445 and 1460. Base plate 1401 may also include additional outside tabs not shown in FIG. 14. Outside tabs may be arranged in a second circular pattern around an aperture of base plate 1401. Each outside tab may be located a second distance equidistant from a center of the aperture. An inner diameter of the second circular pattern may fit an outside diameter of a 30-inch basin. Each tab in the set of outside tabs may be located a fixed radial distance from the set of inside tabs. In some embodiments, each tab in the set of inside tabs may be aligned with each tab in the set of outside tabs. In other embodiments, each tab in the set of inside tabs may not be aligned with each tab in the set of outside tabs. Tabs 1445, 1490, 1455, and 1460 may project downward relative to underside 1440 of base plate 1401.

In some embodiments the fluid runoff system may include a reducing plate 1470. In certain circumstances, a diameter of a drain basin may be too large to fit with one of the sets of tabs of the universal base plate. In that case, the reducing plate may be used to match the diameter of the drain basin to the universal base plate. Reducing plate 1470 may be located below base plate 1401. The top of reducing plate 1470 may connect with the underside 1440 of base plate 1401. Reducing plate 1470 may be connected to base plate 1440 through a friction fit, snap fit, hook and closure connection, screw, or other types of connections. The bottom of reducing plate 1470 may connect with drain basin 1480. The top end of drain basin 1480 may connect with the bottom of reducing plate 1470. Drain basin 1480 and reducing plate 1470 may connect through a friction fit, snap fit, hook and closure connection, screw, or other types of connections.

In some embodiments, reducing plate 1470 may connect to base plate 1401 through outside tabs 1445 and 1460. Reducing plate 1470 may also connect to a third and fourth outside tab not shown in FIG. 14. Reducing plate 1470 may then connect with drain basin 1480. This may allow base plate 1401 to be used with a wider range of drain basins. For example, drain basin 1480 may have an outside diameter of 36 inches. Outside tabs 1445 and 1460 may only be able to accommodate a drain basin with an outside diameter of 30 inches. Reducing plate 1470 may then be used to accommodate drain basin 1480 with an outside diameter of 36 inches.

Figure 15:
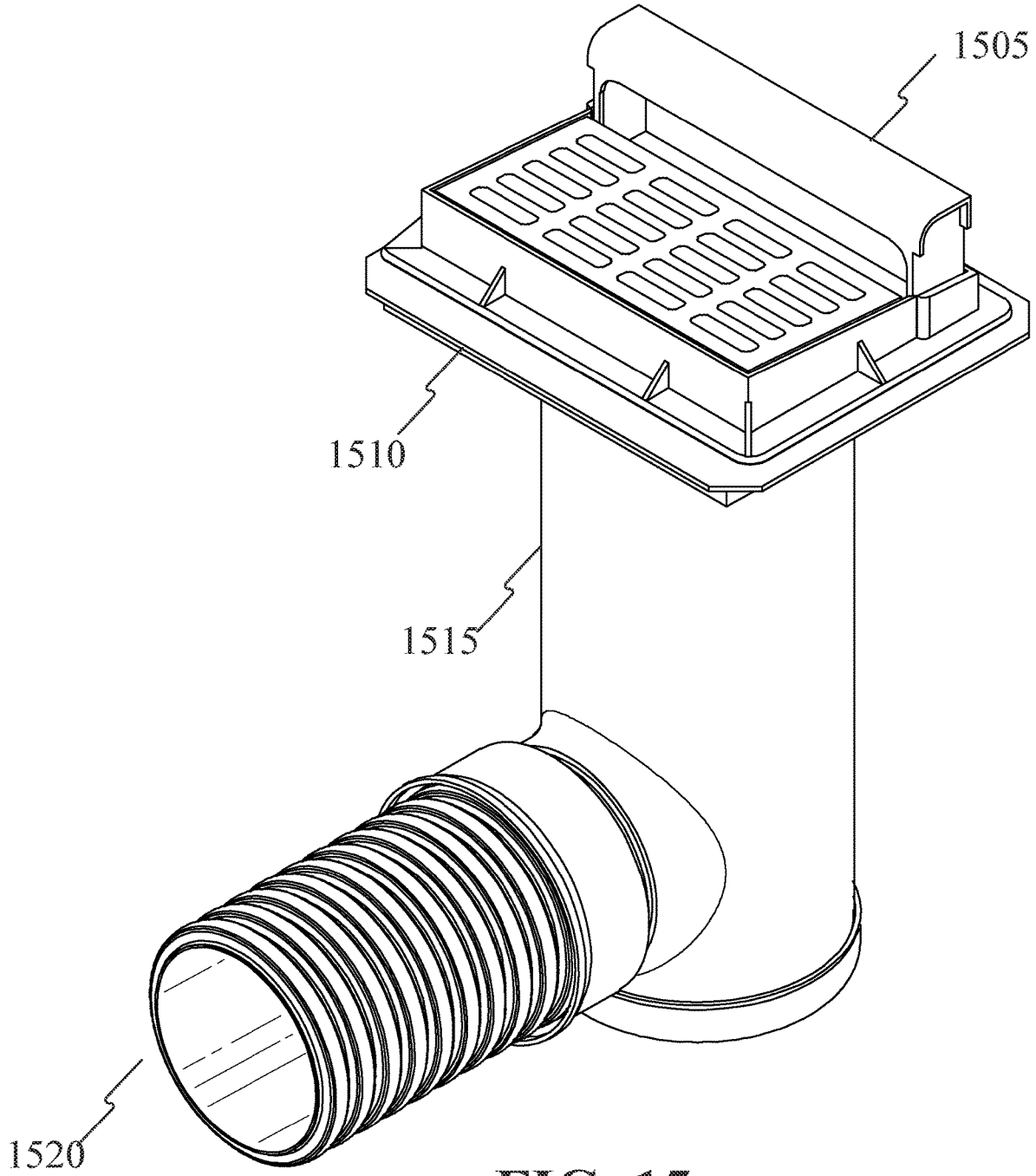
FIG. 15 depicts a side perspective side view of a fluid runoff system containing a curb inlet, base plate, drain basin, and pipe, consistent with various embodiments of the present disclosure.

FIG. 15 depicts a perspective side view of a fluid runoff system. The fluid runoff system may include an inlet casting 1505. Inlet casting 1505 may receive runoff. Inlet casting 1505 may be placed in a curb, street, in the ground, or in any other structural and/or environmental condition. Inlet casting 1505 may be connected to base plate 1510. In some embodiments, inlet casting 1505 may be placed on top of base plate 1510. Inlet casting 1505 may be attached to base plate 1510 through a friction fit, snap fit, hook and closure, or other type of connection.

In another embodiment, base plate 1510 may surround inlet casting 1505. In another embodiment, inlet casting 1505 may surround base plate 1510.

Base plate 1510 may connect with drain basin 1515. As shown in other embodiments, base plate 1510 may contain one or more sets of tabs. These tabs may connect with drain basin 1515.

In some embodiments, drain basin 1515 may connect with pipe 1520. Drain basin 1515 may have a tubular body with an opening for pipe 1520. Pipe 1520 may be corrugated, ribbed, perforated, and/or rigid. Pipe 1520 may be made from polyvinyl chloride (PVC), high density poly ethylene (HDPE), steel, or other types of materials.

In some embodiments, fluid runoff may flow into inlet casting 1505, through base plate 1510 and into drain basin 1515. Then, the fluid runoff may flow from drain basin 1515 into pipe 1520.

The foregoing description has been presented for purposes of illustration. It is not exhaustive and is not limited to precise forms or embodiments disclosed. Modifications and adaptations of the embodiments will be apparent from consideration of the specification and practice of the disclosed embodiments. For example, while certain components have been described as being coupled to one another, such components may be integrated with one another or distributed in any suitable fashion.

Moreover, while illustrative embodiments have been described herein, the scope includes any and all embodiments having equivalent elements, modifications, omissions, combinations (e.g., of aspects across various embodiments), adaptations and/or alterations based on the present disclosure. The elements in the claims are to be interpreted broadly based on the language employed in the claims and not limited to examples described in the present specification or during the prosecution of the application, which examples are to be construed as nonexclusive. Further, the steps of the disclosed methods can be modified in any manner, including reordering steps and/or inserting or deleting steps.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents may be resorted to, falling within the scope of the disclosure.

Other embodiments will be apparent from consideration of the specification and practice of the embodiments disclosed herein. It is intended that the specification and examples be considered as example only, with a true scope and spirit of the disclosed embodiments being indicated by the following claims.

The invention claimed is:

1. A base plate for receiving an inlet casting at a drain basin, the base plate comprising:
   - a plate having a flat surface with an aperture and an outside edge surrounding the flat surface, wherein the flat surface includes an underside, a topside, and one or more concentric rings comprising concentric openings through the flat surface, wherein the one or more concentric rings are configured to be cut to form a complete opening to receive the drain basin;
   - one or more sets of tabs located on the underside of the plate;
   - a raised lip surrounding the outside edge, wherein the raised lip extends upward from the outside edge; and
   - a flange extending in a horizontal direction away from the raised lip, wherein the flange defines a relatively flat surface to receive an inlet casting.

2. The base plate of claim 1, wherein the one or more sets of tabs comprise a set of inside tabs and a set of outside tabs.

3. The base plate of claim 2, wherein the set of inside tabs and the set of outside tabs project downward relative to the underside of the baseplate.

4. The base plate of claim 3, wherein the inside tabs are arranged in a first circular pattern around the aperture and each inside tab is located a first distance equidistant from a center of the aperture.

5. The base plate of claim 2, wherein the set of inside tabs comprises four tabs and wherein the set of outside tabs comprises four tabs.

6. The base plate of claim 4, wherein the outside tabs are arranged in a second circular pattern around the aperture, wherein the second circular pattern is located farther away from the aperture than the first circular pattern, and each outside tab is located a second outside distance equidistant from the center of the aperture.

7. The base plate of claim 2, wherein each tab in the set of outside tabs is located a fixed radial distance from the set of inside tabs.

8. The base plate of claim 2, wherein each tab in the set of inside tabs is aligned with each tab in the set of outside tabs.

9. The base plate of claim 2, wherein each tab in the set of inside tabs is not aligned with each tab in the set of outside tabs.

10. The base plate of claim 4, wherein an inner diameter of the first circular pattern fits an outside diameter of a 24-inch basin.

11. The base plate of claim 6, wherein an inner diameter of the second circular pattern fits an outside diameter of a 30-inch basin.

12. The base plate of claim 1, wherein the flange includes a chamfered edge.

13. The base plate of claim 1, wherein the base plate is comprised of ductile iron.

14. The base plate of claim 1, wherein the flat surface includes four sides and a length of the flange on one side is longer than a length of the flange on the other sides.

15. A fluid runoff system for managing fluid runoff comprising:

an inlet casting;

a base plate for receiving the inlet casting at a drain basin, the base plate comprising:

a plate having a flat surface with an aperture and an outside edge surrounding the flat surface, wherein the flat surface includes an underside, a topside, and one or more concentric rings comprising-concentric openings through the flat surface, wherein the one or more concentric rings are configured to be cut to form a complete opening to receive the drain basin;

one or more sets of tabs located on the underside of the plate;

a raised lip surrounding the outside edge, wherein the raised lip extends upward from the outside edge; and a flange extending in a horizontal direction away from the raised lip, wherein the flange defines a relatively flat surface to receive the inlet casting; and the drain basin below the baseplate, the drain basin having a tubular body, the tubular body including an inner cavity, an outer surface, and a top end; and a pipe connected to the tubular body.

16. The fluid runoff system of claim 15, wherein the one or more sets of tabs comprise a set of inside tabs and a set of outside tabs.

17. The fluid runoff system of claim 16, wherein the set of inside tabs and the set of outside tabs project downward relative to the underside of the baseplate.

18. The fluid runoff system of claim 17, further comprising a reducing plate having a bottom surface and a top surface, wherein the reducing plate is located above the drain basin and below the base plate.

19. The fluid runoff system of claim 18, wherein the top surface of the reducing plate connects with the set of outside tabs.

20. The fluid runoff system of claim 19, wherein the bottom surface of the reducing plate connects with the top end of the drain basin.

* * * * *